US009006986B2

(12) United States Patent
van de Ven et al.

(10) Patent No.: US 9,006,986 B2
(45) Date of Patent: Apr. 14, 2015

(54) SEMICONDUCTOR LIGHT EMITTING DEVICES HAVING SELECTABLE AND/OR ADJUSTABLE COLOR POINTS AND RELATED METHODS

(71) Applicant: Cree, Inc., Durham, NC (US)

(72) Inventors: Antony P. van de Ven, Hong Kong (CN); Jason E. Taylor, Cary, NC (US); Paul K. Pickard, Morrisville, NC (US); Gauss Ho Ching So, Kowloon (HK); Heidi M. Dieringer, Cary, NC (US); Andrew Dummer, Chapel Hill, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/300,293

(22) Filed: Jun. 10, 2014

(65) Prior Publication Data

US 2015/0002034 A1 Jan. 1, 2015

Related U.S. Application Data

(63) Continuation of application No. 13/546,099, filed on Jul. 11, 2012, now Pat. No. 8,791,642, which is a continuation of application No. 13/039,572, filed on Mar. 3, 2011, now Pat. No. 8,796,952.

(51) Int. Cl.
*H05B 37/02* (2006.01)
*H05B 33/08* (2006.01)

(52) U.S. Cl.
CPC ..... *H05B 33/0824* (2013.01); *H05B 33/0896* (2013.01); *H05B 33/086* (2013.01)

(58) Field of Classification Search
None
See application file for complete search history.

(56) References Cited

U.S. PATENT DOCUMENTS

| | | | |
|---|---|---|---|
| 6,350,041 | B1 | 2/2002 | Tarsa et al. |
| 6,384,492 | B1 | 5/2002 | Iversen et al. |
| 6,600,175 | B1 | 7/2003 | Baretz et al. |
| 6,967,116 | B2 | 11/2005 | Negley |
| 7,005,679 | B2 | 2/2006 | Tarsa et al. |

(Continued)

OTHER PUBLICATIONS

Notification of Transmittal of the International Search Report and the Written Opinion of the International Searching Authority, or the Declaration, related to corresponding application No. PCT/US12/26011; Mailing Date Sep. 4, 2012; 14 Pages.

(Continued)

*Primary Examiner* — Crystal L Hammond
(74) *Attorney, Agent, or Firm* — Myers Bigel Sibley & Sajovec, P.A.

(57) ABSTRACT

Semiconductor light emitting devices are provided that include a first string of light emitting diodes ("LED") that emit unsaturated light having a color point that is within at least eight MacAdam ellipses of one or more points within a first blue-shifted-yellow region on the 1931 CIE Chromaticity Diagram, a second string of LEDs that emit unsaturated light having color point that is within at least eight MacAdam ellipses from one or more points within a second blue-shifted-green region on the 1931 CIE Chromaticity Diagram, and a third light source that emits radiation having a dominant wavelength between 600 and 720 nm. A drive circuit is provided that is configured to supply a first drive current to the first string of LEDs, a second drive current to the second string of LEDs and a third drive current to the third string of LEDs, wherein at least two of the first, second and third drive currents are independently controllable.

22 Claims, 13 Drawing Sheets

(56) References Cited

U.S. PATENT DOCUMENTS

| | | | | |
|---|---|---|---|---|
| 7,029,935 | B2 | 4/2006 | Negley et al. | |
| 7,042,020 | B2 | 5/2006 | Negley | |
| 7,183,582 | B2 | 2/2007 | Imamura | |
| 7,326,583 | B2 | 2/2008 | Andrews et al. | |
| 7,517,728 | B2 | 4/2009 | Leung et al. | |
| 7,612,383 | B2 | 11/2009 | Andrews et al. | |
| 7,615,795 | B2 | 11/2009 | Baretz et al. | |
| 7,733,034 | B2 * | 6/2010 | Kotikalapoodi et al. | 315/294 |
| 7,791,092 | B2 | 9/2010 | Tarsa et al. | |
| 7,799,586 | B2 | 9/2010 | Leung et al. | |
| 8,212,466 | B2 | 7/2012 | Negley et al. | |
| 8,436,549 | B2 | 5/2013 | Hasnain | |
| 8,624,505 | B2 | 1/2014 | Huang | |
| 2006/0049416 | A1 | 3/2006 | Baretz et al. | |
| 2007/0278934 | A1 | 12/2007 | Van de Ven et al. | |
| 2008/0054815 | A1 * | 3/2008 | Kotikalapoodi et al. | 315/192 |
| 2008/0106895 | A1 | 5/2008 | Van de Ven et al. | |
| 2008/0130281 | A1 | 6/2008 | Negley | |
| 2008/0136313 | A1 | 6/2008 | Van de Ven et al. | |
| 2008/0179602 | A1 | 7/2008 | Negley et al. | |
| 2008/0224597 | A1 | 9/2008 | Baretz et al. | |
| 2008/0224598 | A1 | 9/2008 | Baretz et al. | |
| 2009/0184616 | A1 | 7/2009 | Van de Ven et al. | |
| 2009/0195169 | A1 * | 8/2009 | Huang et al. | 315/193 |
| 2010/0020532 | A1 | 1/2010 | Negley | |
| 2010/0066255 | A1 * | 3/2010 | Roberts | 315/151 |
| 2010/0127283 | A1 | 5/2010 | van de Ven et al. | |
| 2010/0237786 | A1 * | 9/2010 | Santo et al. | 315/185 R |
| 2010/0245227 | A1 | 9/2010 | Chen et al. | |
| 2010/0254129 | A1 | 10/2010 | Le Toquin et al. | |
| 2010/0254130 | A1 | 10/2010 | Van de Ven et al. | |
| 2010/0290221 | A1 | 11/2010 | Tarsa et al. | |
| 2010/0301360 | A1 | 12/2010 | Van de Ven et al. | |
| 2010/0314996 | A1 | 12/2010 | Van de Ven et al. | |
| 2011/0006330 | A1 | 1/2011 | Leung et al. | |
| 2011/0019399 | A1 | 1/2011 | Van de Ven et al. | |
| 2011/0043137 | A1 | 2/2011 | Negley et al. | |
| 2011/0115407 | A1 | 5/2011 | Wibben et al. | |
| 2011/0204807 | A1 | 8/2011 | Hashizume et al. | |
| 2011/0291564 | A1 | 12/2011 | Huang | |
| 2012/0038286 | A1 | 2/2012 | Hasnain | |
| 2012/0038291 | A1 | 2/2012 | Hasnain | |
| 2012/0062205 | A1 | 3/2012 | Levesque et al. | |
| 2012/0223657 | A1 | 9/2012 | van de Ven | |

OTHER PUBLICATIONS

Hoeler et al., "Color-consistent LED modules for general lighting," Proc. of SPIE vol. 7231 72310A-1, Dec. 2009, p. 6 (online) (retrieved on Aug. 21, 2012) Retrieved from the Internet:<URL: http://144.206.159.178/ft/CONF/16427283/16427285.pdf>.

Kim et al., "Performance of High-Power AlInGaN Light Emitting Diodes," phys.stat.sol. (a) 188, No. 1, Dec. 15-21, 2001, p. 15 (online) (retrieved Aug. 21, 2012) Retrieved from the Internet:<URL:http://yjsy.xmu.edu.cn/CN/Uploads/888fab9b=b2e3-4571-90f1-d8313174c5bd/Web/Work/03pssa188-15.pdf>.

Notification Concerning Transmittal of International Preliminary Report on Patentability, related to corresponding Application No. PCT/US2012/026011, Mailing Date: Mar. 20, 2014, 8 pages.

* cited by examiner

| Target CTT (K) | Trapezoid | | Center Point | | Center Point CCT (K) |
|---|---|---|---|---|---|
| | x | y | x | y | |
| 2700 | 0.4813 | 0.4319 | 0.478 | 0.4101 | 2725 |
| | 0.4562 | 0.4260 | | | |
| | 0.4373 | 0.3893 | | | |
| | 0.4593 | 0.3944 | | | |
| 3000 | 0.4562 | 0.4260 | 0.4338 | 0.4030 | 3027 |
| | 0.4299 | 0.4165 | | | |
| | 0.4147 | 0.3814 | | | |
| | 0.4373 | 0.3893 | | | |
| 3500 | 0.4299 | 0.4165 | 0.4073 | 0.3917 | 3464 |
| | 0.3996 | 0.4015 | | | |
| | 0.3889 | 0.3690 | | | |
| | 0.4147 | 0.3814 | | | |
| 4000 | 0.4006 | 0.4044 | 0.3818 | 0.3797 | 3985 |
| | 0.3736 | 0.3874 | | | |
| | 0.3670 | 0.3578 | | | |
| | 0.3898 | 0.3716 | | | |
| 4500 | 0.3736 | 0.3874 | 0.3611 | 0.3658 | 4503 |
| | 0.3548 | 0.3736 | | | |
| | 0.3512 | 0.3465 | | | |
| | 0.3670 | 0.3578 | | | |
| 5000 | 0.3551 | 0.3760 | 0.3447 | 0.3553 | 5027 |
| | 0.3376 | 0.3616 | | | |
| | 0.3366 | 0.3369 | | | |
| | 0.3515 | 0.3478 | | | |
| 5700 | 0.3376 | 0.3616 | 0.3287 | 0.3417 | 5666 |
| | 0.3207 | 0.3462 | | | |
| | 0.3222 | 0.3243 | | | |
| | 0.3366 | 0.3369 | | | |
| 6500 | 0.3205 | 0.3481 | 0.3123 | 0.3282 | 6532 |
| | 0.3028 | 0.3304 | | | |
| | 0.3068 | 0.3113 | | | |
| | 0.3221 | 0.3261 | | | |

*FIG. 10A*

| | | | Lumen Mix Percentages | | | BXY/BSG Mix Color Point | |
|---|---|---|---|---|---|---|---|
| CCT (K) | CRI Ra | LER | Red L% | BSY L% | BSG L% | x | y |
| 6532 | 94 | 310 | 10% | 30% | 60% | 0.2682 | 0.3302 |
| 5666 | 95 | 318 | 10% | 40% | 50% | 0.2825 | 0.3456 |
| 5027 | 95 | 325 | 11% | 48% | 41% | 0.2970 | 0.3614 |
| 4503 | 95 | 330 | 12% | 54% | 34% | 0.3090 | 0.3745 |
| 3985 | 96 | 337 | 13% | 62% | 26% | 0.3225 | 0.3923 |
| 3465 | 96 | 341 | 15% | 67% | 18% | 0.3421 | 0.4104 |
| 3045 | 96 | 343 | 17% | 72% | 10% | 0.3599 | 0.4297 |
| 2725 | 94 | 344 | 20% | 75% | 5% | 0.3747 | 0.4458 |

*FIG. 10B*

SEMICONDUCTOR LIGHT EMITTING DEVICES HAVING SELECTABLE AND/OR ADJUSTABLE COLOR POINTS AND RELATED METHODS

CROSS-REFERENCE TO RELATED APPLICATIONS

The present application claims priority under 35 U.S.C. §120 as a continuation of U.S. patent application Ser. No. 13/546,099, filed Jul. 11, 2012, which in turn claims priority as a continuation-in-part of U.S. patent application Ser. No. 13/039,572, filed Mar. 3, 2011. The entire contents of both of the above applications is incorporated herein by reference as if set forth in their entireties.

BACKGROUND

The present invention relates to light emitting devices and, more particularly, to semiconductor light emitting devices that include multiple different types of light emitting devices.

A wide variety of light emitting devices are known in the art including, for example, incandescent light bulbs, fluorescent lights and semiconductor light emitting devices such as light emitting diodes ("LEDs"). LEDs have the potential to exhibit very high efficiencies relative to conventional incandescent or fluorescent lights. However, significant challenges remain in providing LED lamps that simultaneously achieve high efficiencies, high luminous flux, good color reproduction and acceptable color stability.

LEDs generally include a series of semiconductor layers that may be epitaxially grown on a substrate such as, for example, a sapphire, silicon, silicon carbide, gallium nitride or gallium arsenide substrate. One or more semiconductor p-n junctions are formed in these epitaxial layers. When a sufficient voltage is applied across the p-n junction, electrons in the n-type semiconductor layers and holes in the p-type semiconductor layers flow toward the p-n junction. As the electrons and holes flow toward each other, some of the electrons will "collide" with corresponding holes and recombine. Each time this occurs, a photon of light is emitted, which is how LEDs generate light. The wavelength distribution of the light generated by an LED generally depends on the semiconductor materials used and the structure of the thin epitaxial layers that make up the "active region" of the device (i.e., the area where the light is generated).

Most LEDs are nearly monochromatic light sources that appear to emit light having a single color. Thus, the spectral power distribution of the light emitted by most LEDs is tightly centered about a "peak" wavelength, which is the single wavelength where the spectral power distribution or "emission spectrum" of the LED reaches its maximum as detected by a photo-detector. The "width" of the spectral power distribution of most LEDs is between about 10 nm and 30 nm, where the width is measured at half the maximum illumination on each side of the emission spectrum (this width is referred to as the full-width-half-maximum or "FWHM" width). LEDs are often identified by their "peak" wavelength or, alternatively, by their "dominant" wavelength. The dominant wavelength of an LED is the wavelength of monochromatic light that has the same apparent color as the light emitted by the LED as perceived by the human eye. Because the human eye does not perceive all wavelengths equally (it perceives yellow and green better than red and blue), and because the light emitted by most LEDs is actually a range of wavelengths, the color perceived (i.e., the dominant wavelength) may differ from the peak wavelength.

In order to use LEDs to generate white light, LED lamps have been provided that include several LEDs that each emit a light of a different color. The different colors combine to produce a desired intensity and/or color of white light. For example, by simultaneously energizing red, green and blue LEDs, the resulting combined light may appear white, or nearly white, depending on, for example, the relative intensities, peak wavelengths and spectral power distributions of the source red, green and blue LEDs.

White light may also be produced by partially or fully surrounding a blue, purple or ultraviolet LED with one or more luminescent materials such as phosphors that convert some of the light emitted by the LED to light of one or more other colors. The combination of the light emitted by the LED that is not converted by the luminescent material(s) (if any) and the light of other colors that are emitted by the luminescent material(s) may produce a white or near-white light.

As one example, a white LED lamp may be formed by coating a gallium nitride-based blue LED with a yellow luminescent material such as a cerium-doped yttrium aluminum garnet phosphor (which has the chemical formula $Y_3Al_5O_{12}$:Ce, and is commonly referred to as YAG:Ce). The blue LED produces an emission with a peak wavelength of, for example, about 460 nm. Some of blue light emitted by the LED passes between and/or through the YAG:Ce phosphor particles without being down-converted, while other of the blue light emitted by the LED is absorbed by the YAG:Ce phosphor, which becomes excited and emits yellow fluorescence with a peak wavelength of about 550 nm (i.e., the blue light is down-converted to yellow light). A viewer will perceive the combination of blue light and yellow light that is emitted by the coated LED as white light. This light is typically perceived as being cool white in color, as it primarily includes light on the lower half (shorter wavelength side) of the visible emission spectrum. To make the emitted white light appear more "warm" and/or exhibit better color rendering properties, red-light emitting luminescent materials such as $CaAlSiN_3$ based phosphor particles may be added to the coating. Alternatively, the cool white emissions from the combination of the blue LED and the YAG:Ce phosphor may be supplemented with a red LED (e.g., comprising AlInGaP, having a dominant wavelength of approximately 619 nm) to provide warmer light.

Phosphors are the luminescent materials that are most widely used to convert a single-color (typically blue or violet) LED into a white LED. Herein, the term "phosphor" may refer to any material that absorbs light at one wavelength and re-emits light at a different wavelength in the visible spectrum, regardless of the delay between absorption and re-emission and regardless of the wavelengths involved. Thus, the term "phosphor" encompasses materials that are sometimes called fluorescent and/or phosphorescent. In general, phosphors may absorb light having first wavelengths and re-emit light having second wavelengths that are different from the first wavelengths. For example, "down-conversion" phosphors may absorb light having shorter wavelengths and re-emit light having longer wavelengths. In addition to phosphors, other luminescent materials include scintillators, day glow tapes, nanophosphors, quantum dots, and inks that glow in the visible spectrum upon illumination with (e.g., ultraviolet) light.

A medium that includes one or more luminescent materials that is positioned to receive light that is emitted by an LED or other semiconductor light emitting device is referred to herein as a "recipient luminophoric medium." Exemplary recipient luminophoric mediums include layers having luminescent materials that are coated or sprayed directly onto, for example, a semiconductor light emitting device or on surfaces of a lens or other elements of the packaging thereof, and clear encapsulents (e.g., epoxy-based or silicone-based curable resin) that include luminescent materials that are arranged to partially or fully cover a semiconductor light emitting device. A recipient luminophoric medium may include one medium, layer or the like in which one or more luminescent materials are mixed, multiple stacked layers or mediums, each of which may include one or more of the same or different luminescent materials, and/or multiple spaced apart layers or mediums, each of which may include the same or different luminescent materials.

SUMMARY

Pursuant to some embodiments of the present invention, methods of fabricating a semiconductor light emitting device are provided in which a first string of light emitting diodes ("LED") is provided that comprises a first LED that has a first recipient luminophoric medium, The first recipient luminophoric medium comprises a first luminescent material that emits light comprising a peak wavelength within the green color range in response to radiation emitted by the first LED. A second string of LEDs is provided that comprises a second LED that has a second recipient luminophoric medium that comprises a second luminescent material that emits light comprising a peak wavelength within the yellow color range in response to radiation emitted by the second LED. A third string of LEDs is provided that comprises a third LED that emits light comprising a distinct spectral peak within the red color range or the orange color range. The LEDs included in the first string and in the second string are selected so that when the first string and second string are operated at pre-selected drive current levels the combined light output of the first string and the second string is on a line on the 1931 CIE Chromaticity Diagram that is defined by the color point for the combined output of the third sting and a pre-selected color point for the light output by the semiconductor light emitting device.

In some embodiments, the pre-selected drive current levels may be pre-selected based on efficiency characteristics for the LEDs in the respective first and second strings. The first string of LEDs may further comprise a fourth LED that has a fourth recipient luminophoric medium that comprises a fourth luminescent material that emits light comprising a peak wavelength within the yellow color range in response to radiation emitted by the fourth LED. The second string of LEDs may further comprise a fifth LED that has a fifth recipient luminophoric medium that comprises a fifth luminescent material that emits light comprising a peak wavelength within the green color range in response to radiation emitted by the fifth LED.

In some embodiments, the second recipient luminophoric medium may further comprise a third luminescent material that emits green light in response to light emitted by the first LED. The first recipient luminophoric medium may further comprise a third luminescent material that emits yellow light in response to light emitted by the first LED. In such embodiments, the second recipient luminophoric medium may further comprise a fourth luminescent material that emits green light in response to light emitted by the first LED.

In some embodiments, the semiconductor light emitting device may further comprise a drive circuit that is configured to provide first, second and third drive currents to the respective first, second and third LED strings, where at least two of the first, second and third drive currents are independent of each other. The color point of the combined output of the first string of LEDs and the color point of the combined output of the second string of LEDs at the pre-selected drive current levels for the first and second strings of LEDs may be approximately equidistant from the line on the 1931 CIE Chromaticity Diagram that is defined by the color point for the combined output of the third sting and the pre-selected color point for the light output by the semiconductor light emitting device. A drive current for the third string of LEDs may be factory set using at least one of an adjustable resistor, a resistor network, a digital-to-analog converter with flash memory or a fuse link diode.

Pursuant to further embodiments of the present invention, semiconductor light emitting devices are provided that comprise a first LED string that comprises a first LED that has a first recipient luminophoric medium that comprises a first luminescent material that emits light comprising a peak wavelength within the green color range in response to radiation emitted by the first LED; a second LED string that comprises a second LED that has a second recipient luminophoric medium that comprises a second luminescent material that emits light comprising a peak wavelength within the yellow color range in response to radiation emitted by the second LED; a third LED string that comprises a third LED that emits light comprising a distinct spectral peak within the red color range or the orange color range; and a drive circuit that is responsive to input from an end user of the semiconductor light emitting device, the drive circuit configured to adjust the relative values of the drive currents provided to the LEDs in the first and second LED strings to adjust a color point of the light emitted by the semiconductor light emitting device.

In some embodiments, the drive circuit may be configured to allow an end user to adjust the color point of the light emitted by the semiconductor light emitting device to approximately move along a pre-selected portion of the black body locus on the 1931 CIE Chromaticity Diagram. The drive circuit may be factory set to provide a fixed drive current to the LEDs in the third LED string. The semiconductor light emitting device may further comprise a user input device that generates a control signal that is provided to the drive circuit. The user input device may be a first user input device and the control signal may be a first control signal, and the semiconductor light emitting device may further comprise a second user input device that generates a second control signal that is provided to the drive circuit.

In some embodiments, the user input device may be configured to allow the end user to select a color point from a continuous range of color points. The user input device may comprise a first setting that controls the drive circuit to drive the first, second and third LED strings to emit light comprising a first color point comprising a color temperature between 4000K and 5000K and a second setting that controls the drive circuit to drive the first, second and third LED strings to emit light comprising a second color point comprising a color temperature between 2500K and 3500K. The drive circuit may be configured to drive the respective first, second and third LED strings so that they generate a combined light output comprising a color point that is within three MacAdam ellipses from a selected color point on the black-body locus.

Pursuant to still further embodiments of the present invention, semiconductor light emitting devices are provided that comprise a first light emitting diode ("LED") string that comprises a first LED that has a first recipient luminophoric medium that comprises a first luminescent material that emits light comprising a peak wavelength within the green color range in response to radiation emitted by the first LED; a second LED string that comprises a second LED that has a second recipient luminophoric medium that comprises a second luminescent material that emits light comprising a peak wavelength within the yellow color range in response to radiation emitted by the second LED; a third LED string that comprises a third LED that emits light comprising a distinct spectral peak within the red color range or the orange color range; and a multi-position switch comprising a plurality of settings that correspond to a plurality of different pre-selected drive current values for driving the respective first, second and third LED strings to provide light comprising pre-selected color points.

In some embodiments, the pre-selected color points may comprise multiple color points that are along a pre-selected portion of the black body locus on the 1931 CIE Chromaticity Diagram. The semiconductor light emitting device may emit a warm white light comprising a correlated color temperature between about 2500K and about 4100K, a CRI Ra value of at least 90 and an r9 value of at least 90. The semiconductor light emitting device may have a luminous efficiency of at least 130 lumens/watt.

BRIEF DESCRIPTION OF THE DRAWINGS

FIGS. 10A and 10B are tables illustrating various parameters and simulated performance characteristics of devices according to embodiments of the present invention that are designed to achieve target color temperatures along the black-body locus.

DETAILED DESCRIPTION

Figure 1:
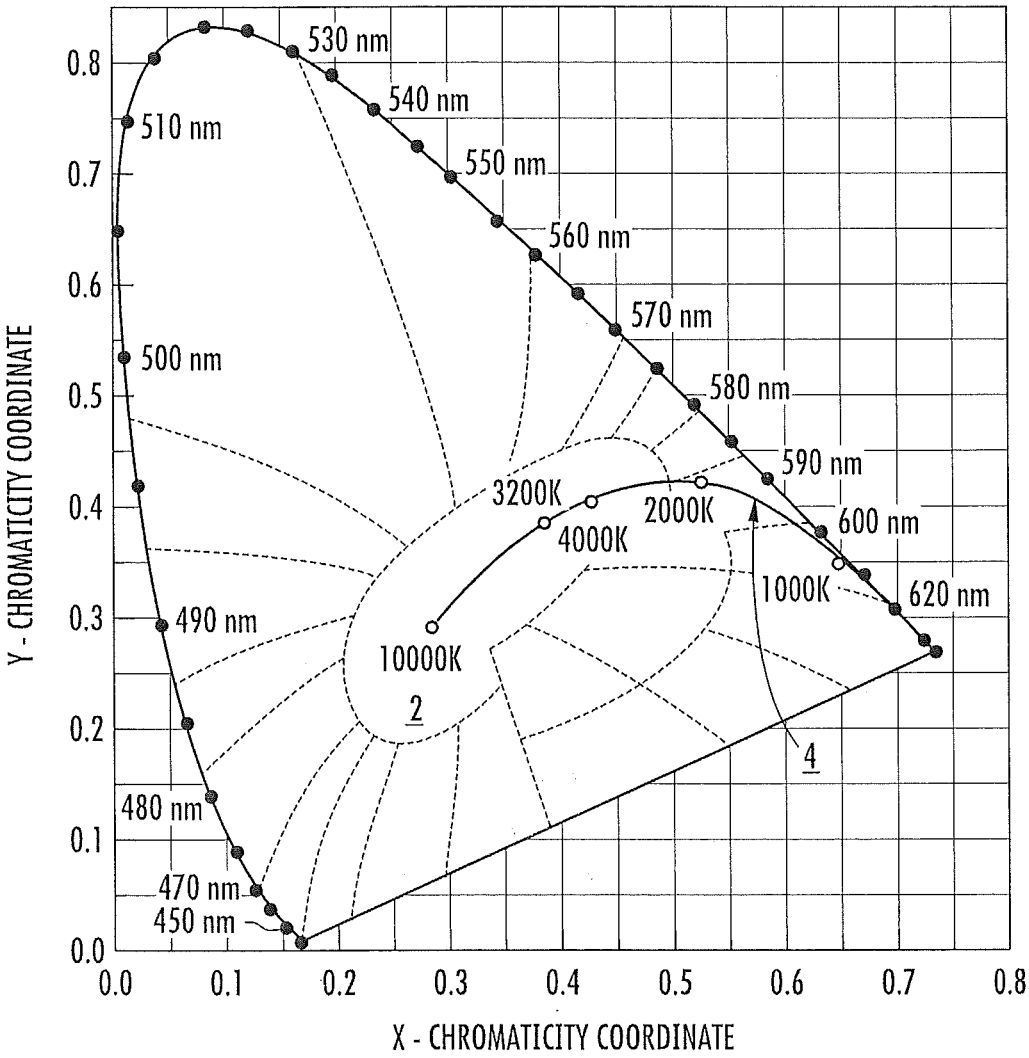
FIG. 1 is a graph of a 1931 CIE Chromaticity Diagram illustrating the location of the black-body locus.

Certain embodiments of the present invention are directed to packaged semiconductor light emitting devices that include multiple "strings" of light emitting devices such as LEDs. Herein, a "string" of light emitting devices refers to a group of at least one light emitting device, such as an LED, that are driven by a common current source. The common current source may be used to drive multiple strings, which strings may be arranged in series, in parallel, or in other configurations.

At least some of the light emitting devices in the multiple strings have associated recipient luminophoric mediums that include one or more luminescent materials. Moreover, some or all of these multiple strings may be driven by independently controllable current sources. For example, in some embodiments, the packaged semiconductor light emitting device may include two independently controllable strings, which may allow the packaged semiconductor light emitting device to be adjusted to emit light having a desired color. In other embodiments, the packaged semiconductor light emitting device may include three or more independently controllable strings. In some embodiments, the device may be adjusted at the factory to emit light of a desired color, while in other embodiments, end users may be provided the ability to select the color of light emitted by the device from a range of different colors.

In some embodiments, the packaged semiconductor light emitting device may include at least blue, green, yellow and red light sources. For example, a device may have three strings of LEDs, where the first string comprises one or more blue LEDs that each have a recipient luminophoric medium that contains a yellow light emitting phosphor, the second string comprises one or more blue LEDs that each have a recipient luminophoric medium that contains a green light emitting phosphor, and the third string comprises one or more red LEDs or, alternatively, one or more blue LEDs that each have a recipient luminophoric medium that contains a red light emitting phosphor.

As used herein, the term "semiconductor light emitting device" may include LEDs, laser diodes and any other light emitting devices that includes one or more semiconductor layers, regardless of whether or not the light emitting devices are packaged into a lamp, fixture or the like. The semiconductor layers included in these devices may include silicon, silicon carbide, gallium nitride and/or other semiconductor materials, an optional semiconductor or non-semiconductor substrate, and one or more contact layers which may include metal and/or other conductive materials. The expression "light emitting device," as used herein, is not limited, except that it be a device that is capable of emitting light.

A packaged semiconductor light emitting device is a device that includes at least one semiconductor light emitting device (e.g., an LED or an LED coated with a recipient luminophoric medium) that is enclosed with packaging elements to provide one or more of environmental protection, mechanical protection, light mixing, light focusing or the like, as well as electrical leads, contacts, traces or the like that facilitate electrical connection to an external circuit. Encapsulant material, optionally including luminescent material, may be disposed over the semiconductor light emitting device. Multiple semiconductor light emitting devices may be provided in a single package.

Semiconductor light emitting devices according to embodiments of the invention may include III-V nitride (e.g., gallium nitride) based LEDs fabricated on a silicon carbide, sapphire or gallium nitride substrates such as various devices manufactured and/or sold by Cree, Inc. of Durham, N.C. Such LEDs may (or may not) be configured to operate such that light emission occurs through the substrate in a so-called "flip chip" orientation. These semiconductor light emitting devices may have a cathode contact on one side of the LED, and an anode contact on an opposite side of the LED, or may alternatively have both contacts on the same side of the device. Some embodiments of the present invention may use semiconductor light emitting devices, device packages, fixtures, luminescent materials, power supplies and/or control elements such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272. The design and fabrication of semiconductor light emitting devices are well known to those skilled in the art, and hence further description thereof will be omitted.

Visible light may include light having many different wavelengths. The apparent color of visible light to humans can be illustrated with reference to a two-dimensional chromaticity diagram, such as the 1931 CIE Chromaticity Diagram illustrated in FIG. 1. Chromaticity diagrams provide a useful reference for defining colors as weighted sums of colors.

As shown in FIG. 1, colors on a 1931 CIE Chromaticity Diagram are defined by x and y coordinates (i.e., chromaticity coordinates, or color points) that fall within a generally U-shaped area that includes all of the hues perceived by the human eye. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 2 in FIG. 1. There are many different hues of light that may be considered "white," as evidenced by the size of the region 2. For example, some "white" light, such as light generated by tungsten filament incandescent lighting devices, may appear yellowish in color, while other "white" light, such as light generated by some fluorescent lighting devices, may appear more bluish in color.

Each point in the diagram of FIG. 1 is referred to as the "color point" of a light source that emits a light having that color. As shown in FIG. 1 a locus of color points that is referred to as the "black-body" locus 4 exists which corresponds to the location of color points of light emitted by a black-body radiator that is heated to various temperatures. The black-body locus 4 is also referred to as the "planckian" locus because the chromaticity coordinates (i.e., color points) that lie along the black-body locus obey Planck's equation: $E(\lambda)=A\lambda^{-5}/(e^{B/T}-1)$, where E is the emission intensity, λ is the emission wavelength, T is the color temperature of the black-body and A and B are constants. Color coordinates that lie on or near the black-body locus 4 yield pleasing white light to a human observer.

As a heated object becomes incandescent, it first glows reddish, then yellowish, and finally bluish with increasing temperature. This occurs because the wavelength associated with the peak radiation of the black-body radiator becomes progressively shorter with increased temperature, consistent with the Wien Displacement Law. Illuminants that produce light which is on or near the black-body locus 4 can thus be described in terms of their correlated color temperature (CCT). The 1931 CIE Diagram of FIG. 1 includes temperature listings along the black-body locus that show the color path of a black-body radiator that is caused to increase to such temperatures. As used herein, the term "white light" refers to light that is perceived as white, is within 7 MacAdam ellipses of the black-body locus on a 1931 CIE chromaticity diagram, and has a CCT ranging from 2000K to 10,000K. White light with a CCT of 3000K may appear yellowish in color, while white light with a CCT of 8000K or more may appear more bluish in color, and may be referred to as "cool" white light. "Warm" white light may be used to describe white light with a CCT of between about 2500K and 4500K, which is more reddish or yellowish in color. Warm white light is generally a pleasing color to a human observer. Warm white light with a CCT of 2500K to 3300K may be preferred for certain applications.

The ability of a light source to accurately reproduce color in illuminated objects is typically characterized using the color rendering index ("CRI Ra"). The CRI Ra of a light source is a modified average of the relative measurements of how the color rendition of an illumination system compares to that of a reference black-body radiator when illuminating eight reference colors that are referred to as r1 through r8. Thus, the CRI Ra is a relative measure of the shift in surface color of an object when lit by a particular lamp. The CRI Ra equals 100 if the color coordinates of a set of test colors being illuminated by the illumination system are the same as the coordinates of the same test colors being irradiated by the black-body radiator. Daylight generally has a CRI Ra of nearly 100, incandescent bulbs have a CRI Ra of about 95, fluorescent lighting typically has a CRI Ra of about 70 to 85, while monochromatic light sources have a CRI Ra of essentially zero. Light sources for general illumination applications with a CRI Ra of less than 50 are generally considered very poor and are typically only used in applications where economic issues preclude other alternatives. Light sources with a CRI Ra value between 70 and 80 have application for general illumination where the colors of objects are not important. For some general interior illumination, a CRI Ra value of greater than 80 is acceptable. A light source with color coordinates within 4 MacAdam step ellipses of the black-body locus 4 and a CRI Ra value that exceeds 85 is more suitable for general illumination purposes. Light sources with CRI Ra values of more than 90 provide good color quality.

For backlight, general illumination and various other applications, it is often desirable to provide a lighting source that generates white light having a relatively high CRI Ra, so that objects illuminated by the lighting source may appear to have more natural coloring to the human eye. Accordingly, such lighting sources may typically include an array of semiconductor lighting devices including red, green and blue light emitting devices. When red, green and blue light emitting devices are energized simultaneously, the resulting combined light may appear white, or nearly white, depending on the color points and relative intensities of the red, green and blue sources. However, even light that is a combination of red, green and blue emitters may have a low CRI Ra, particularly if the emitters generate saturated light, because such light may lack contributions from many visible wavelengths.

As noted above, CRI Ra is an average color rendering value for eight specific sample colors that are generally referred to as r1-r8. Additional sample colors r9-r15 are now also often used in evaluating the color rendering properties of a light source. The sample color r9 is the saturated red color, and it is generally known that the ability to reproduce red colors well is key for accurately rendering colors, as the color red is often found mixed into processed colors. Accordingly, all else being equal, lamps with high r9 values tend to produce the most vivid colors. Generally speaking, lamps with r9 values of above 90 are desirable in many settings.

Pursuant to embodiments of the present invention, semiconductor light emitting devices are provided that may be designed to emit warm white light and to have high CRI Ra values including CRI Ra values that can exceed 90. These devices may also exhibit high r9 values (e.g., r9 values that exceed 90), and may have high luminous power output and efficacy.

In some embodiments, the semiconductor light emitting devices may comprise multi-emitter devices that have one or more light emitting devices that emit radiation in three (or more) different color ranges or regions. By way of example, the semiconductor light emitting device may include a first group of one or more LEDs that combine to emit radiation having a first color point on the 1931 CIE Chromaticity Diagram that falls within a first color range or region, a second group of one or more LEDs that combine to emit radiation having a second color point on the 1931 CIE Chromaticity Diagram that falls within a second color range or region, and a third group of one or more LEDs that combine to emit radiation having a third color point on the 1931 CIE Chromaticity Diagram that falls within a third color range or region.

The drive current that is provided to a first of the groups of LEDs may be adjusted to move the color point of the combined light emitted by the first and second groups of LEDs along a line that extends between the first color point and the second color point. The drive current that is provided to a third of the groups of LEDs may likewise be adjusted to move the color point of the combined light emitted by the first, second and third groups of LEDs along a line that extends between the third color point and the color point of the combined light emitted by the first and second groups of LEDs. By adjusting the drive currents in this fashion the color point of the radiation emitted by the packaged semiconductor light emitting device can be adjusted to a desired color point such as, for example, a color point having a desired color temperature along the black-body locus 4 of FIG. 1. In some embodiments, these adjustments may be performed at the factory and the semiconductor light emitting device may be set at the factory to a desired color point. In other embodiments, end users may be provided the ability to adjust the drive currents provided to one or more of the first, second and third groups of LEDs and thus select a particular color point for the device. The end user may be provided a continuous range of color points to choose between or two or more discrete pre-selected color points.

Figure 2:
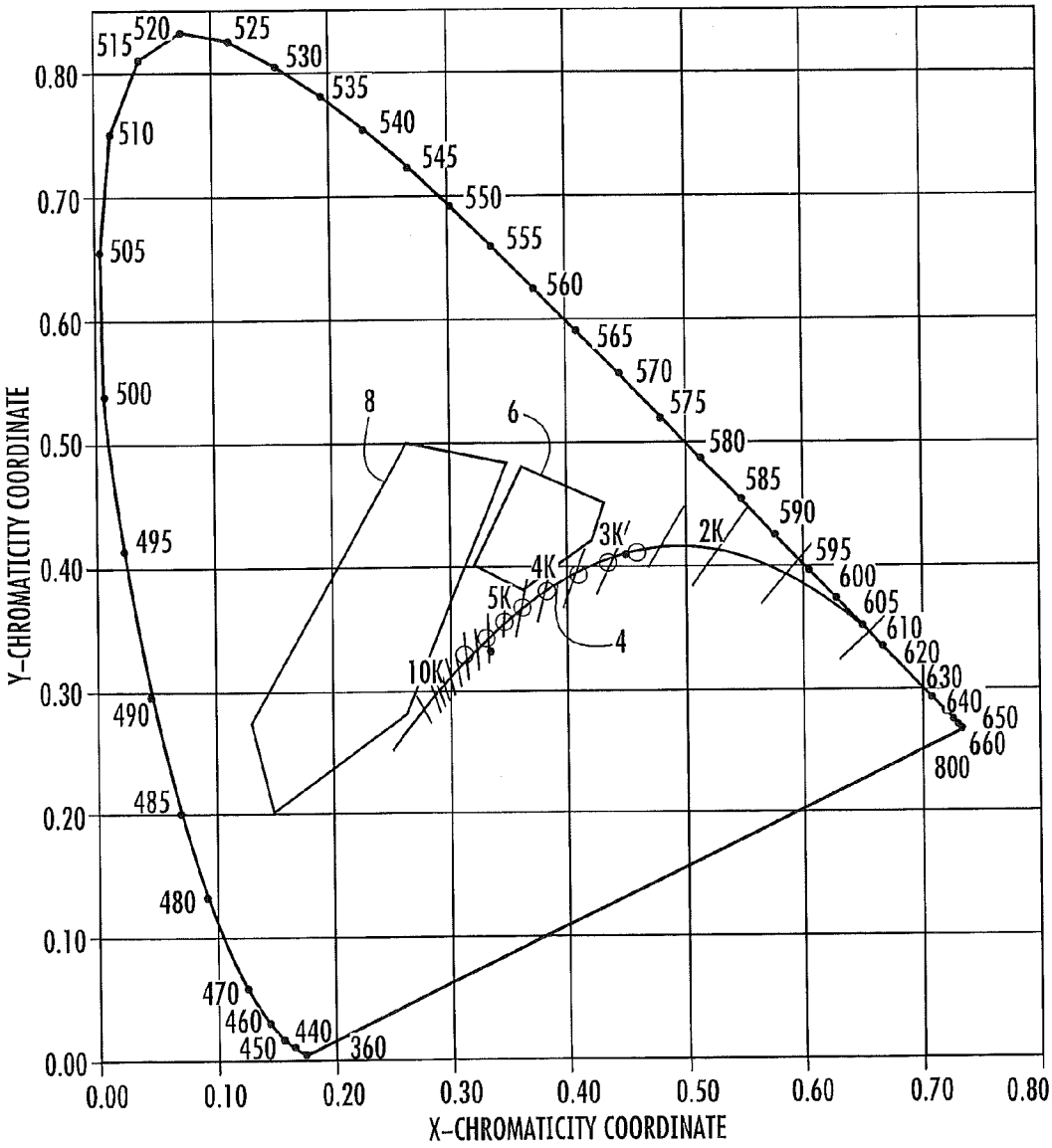
FIG. 2 is another version of the 1931 CIE Chromaticity Diagram that includes trapezoids illustrating color points that may be produced by blue-shifted-yellow and blue-shifted-green LEDs.

In some embodiments, the first group of LEDs may comprise one or more blue-shifted-yellow LEDs ("BSY LED"), and the second group of LEDs may comprise one or more blue-shifted-green LEDs ("BSG LED"). The third group of LEDs may comprise one or more red LEDs (e.g., InAlGaP LEDs or organic LEDs) and/or one or more blue-shifted-red LEDs ("BSR LED"). For purposes of this disclosure, a "red LED" refers to an LED that emits nearly saturated radiation having a peak wavelength between 600 and 720 nm, and a "blue LED" refers to an LED that emits nearly saturated radiation having a peak wavelength between 400 and 490 nm. A "BSY LED" refers to a blue LED and an associated recipient luminophoric medium that together emit light having a color point that falls within a trapezoidal "BSY region" on the 1931 CIE Chromaticity Diagram defined by the following x, y chromaticity coordinates: (0.32, 0.40), (0.36, 0.48), (0.43, 0.45), (0.42, 0.42), (0.36, 0.38), (0.32, 0.40), which is generally within the yellow color range. A "BSG LED" refers to a blue LED and an associated recipient luminophoric medium that together emit light having a color point that falls within a trapezoidal "BSG region" on the 1931 CIE Chromaticity Diagram defined by the following x, y chromaticity coordinates: (0.35, 0.48), (0.26, 0.50), (0.13, 0.26), (0.15, 0.20), (0.26, 0.28), (0.35, 0.48), which is generally within the green color range. A "BSR LED" refers to a blue LED that includes a recipient luminophoric medium that emits light having a dominant wavelength between 600 and 720 nm in response to the light emitted by the blue LED. A BSR LED will typically have two distinct spectral peaks on a plot of light output versus wavelength, namely a first peak at the peak wavelength of the blue LED in the blue color range and a second peak at the peak wavelength of the luminescent materials in the recipient luminophoric medium when excited by the light from the blue LED, which is within the red color range. Typically, the red LEDs and/or BSR LEDs will have a dominant wavelength between 600 and 660 nm, and in most cases between 600 and 640 nm. FIG. 2 is a reproduction of the 1931 CIE Chromaticity Diagram that graphically illustrates the BSY region 6 and the BSG region 8 and shows the locations of the BSY region 6 and the BSG region 8 with respect to the black-body locus 4.

Figure 3:
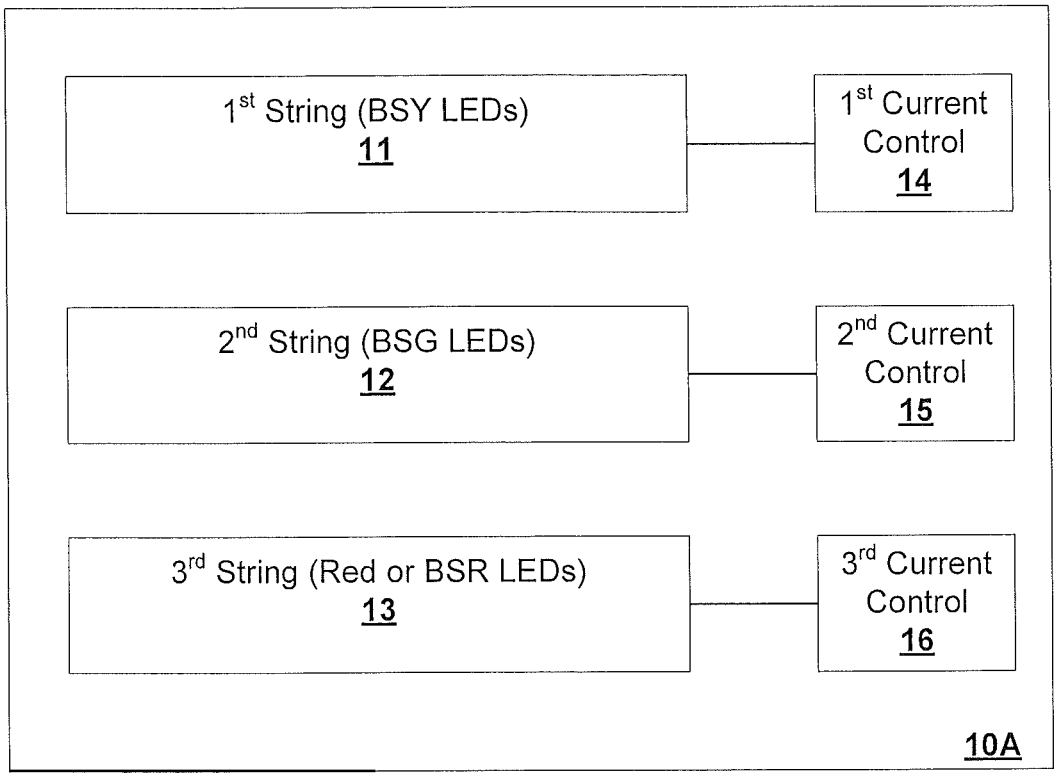
FIG. 3 is a schematic block diagram of a semiconductor light emitting device according to certain embodiments of the present invention.

FIG. 3 is a schematic diagram of a semiconductor light emitting device 10A according to certain embodiments of the present invention.

As shown in FIG. 3, the packaged semiconductor light emitting device 10A includes a first string of light emitting devices 11, a second string of light emitting devices 12, and a third string of light emitting devices 13. In the pictured embodiment, the first string 11 comprises one or more BSY LEDs, the second string 12 comprises one or more BSG LEDs, and the third string 13 comprises one or more red LEDs and/or one or more BSR LEDs. When a string 11, 12, 13 includes multiple LEDs, the LEDs in the string are typically arranged in series, although other configurations are possible.

As further shown in FIG. 3, the semiconductor light emitting device 10A also includes first, second and third current control circuits 14, 15, 16. The first, second and third current control circuits 14, 15, 16 may be configured to provide respective drive currents to the first, second and third strings of LEDs 11, 12, 13. The first, second and third current control circuits 14, 15, 16 may be used to set the drive currents that are provided to the respective first through third strings of LEDs 11, 12, 13 at desired levels. The drive current levels may be selected so that the device 10A will emit combined radiation that has a color point at or near a desired color point. While the device 10A of FIG. 3 includes three current control circuits 14, 15, 16, it will be appreciated in light of the discussion below that other configurations are possible. For example, in other embodiments, one of the current control circuit 14, 15, 16 may be replaced with a non-adjustable drive circuit that provides a fixed drive current to its respective LED string.

Typically, a packaged semiconductor light emitting device such as the device 10A of FIG. 3 will be designed to emit light having a specific color point. This target color point is often on the black-body locus 4 of FIG. 1 and, in such cases, the target color point may be expressed as a particular color temperature along the black-body locus 4. For example, a warm white downlight for residential applications (such downlights are used as replacements for 65 Watt incandescent "can" lights that are routinely mounted in the ceilings of homes) may have a specified color temperature of 3100K, which corresponds to the point labeled "A" on the 1931 CIE Chromaticity Diagram of FIG. 1. Producing light that has this color temperature may be achieved, for example, by selecting some combination of LEDs and recipient luminophoric mediums that together produce light that combines to have the specified color point.

Unfortunately, a number of factors may make it difficult to produce semiconductor light emitting devices that emit light at or near a desired color point. As one example, the plurality of LEDs that are produced by singulating an LED wafer will rarely exhibit identical characteristics. Instead, the output power, peak wavelength, FWHM width and other characteristics of singulated LEDs from a given wafer will exhibit some degree of variation. Likewise, the thickness of a recipient luminophoric medium that is coated on an LED wafer or on a singulated LED may also vary, as may the concentration and size distribution of the luminescent materials therein. Such variations will result in variations in the spectral power output of the light emitted by the luminescent materials.

The above-discussed variations (and others) can complicate a manufacturers efforts to produce semiconductor light emitting devices having a pre-selected color point. By way of example, if a particular semiconductor light emitting device is designed to use blue LEDs having a peak wavelength of 460 nm in order to achieve a specified color temperature along the black-body locus 4 of FIG. 1, then an LED wafer that is grown to provide 460 nm LED chips may only produce a relatively small quantity of 460 nm LED chips, with the remainder of the wafer producing LEDs having peak wavelengths at a distribution around 460 nm (e.g., 454 to 464 nm). If a manufacturer wants to remain very close to the desired color point, it may decide to only use LED chips that have a peak wavelength of 460 nm or only use LEDs having peak wavelengths that are very close to 460 nm (e.g., 459 to 461 nm). If such a decision is made, then the manufacturer will need to grow or purchase a larger number of LED wafers to obtain the necessary number of LEDs that have peak wavelengths within the acceptable range, and will also need to find markets for the LEDs that have peak wavelengths outside the acceptable range.

In order to reduce the number of LED wafers that must be grown or purchased, an LED manufacturer can, for example, increase the size of the acceptable range of peak wavelengths by selecting LEDs on opposite sides of the specified peak wavelength. By way of example, if a particular design requires LEDs having a peak wavelength of 460 nm, then use of LEDs having peak wavelengths of 457 nm and 463 nm may together produce light that is relatively close to the light emitted by an LED from the same wafer that has a peak wavelength of 460 nm. Thus, a manufacturer can "blend" multiple LEDs together to produce the equivalent of the desired LED. A manufacturer may use similar "blending" techniques with respect to variations in the output power of LEDs, FWHM width and various other parameters. As the number of parameters is increased, the task of determining combinations of multiple LEDs (and luminescent materials) that will have a combined color point that is close to a desired color point can be a complex undertaking.

Pursuant to embodiments of the present invention, methods of tuning a semiconductor light emitting device are provided that can be used to adjust the light output thereof such that the emitted light is at or near a desired color point. Pursuant to these methods, the current provided to at least two different strings of light emitting devices that are included in the device may be separately adjusted in order to set the color point of the device at or near a desired value. These methods will now be described with respect to FIG. 4, which is a reproduction of the 1931 CIE Chromaticity Diagram that includes annotations illustrating how the device 10A of FIG. 3 may be tuned to emit light having a color point at or near a desired color point.

Figure 4:
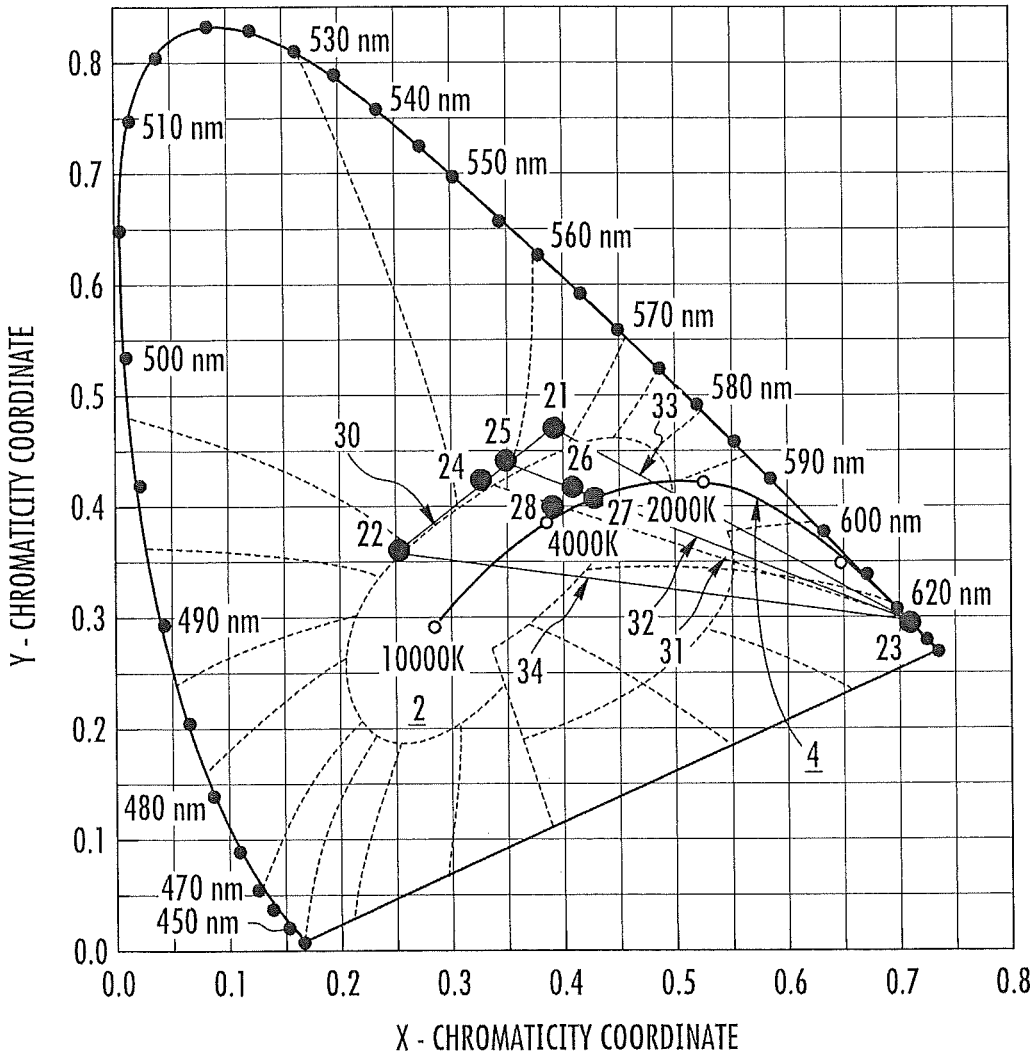
FIG. 4 is an annotated version of the 1931 CIE Chromaticity Diagram that illustrates how a light emitting device can be tuned to achieve a desired color point along the black-body locus according to certain embodiments of the present invention.

Referring to FIGS. 3 and 4, a point labeled 21 on the graph of FIG. 4 represents the color point of the combined light output of the first string of BSY LEDs 11, a point labeled 22 represents the color point of the combined light output of the second string of BSG LEDs 12, and a point labeled 23 represents the color point of the combined light output of the third string of red or BSR LEDs 13. The points 21 and 22 define a first line 30. The light emitted by the combination of the first string of BSY LEDs 11 and the second string of BSG LEDs 12 will be a color point along line 30, with the location of the color point dependent upon the relative intensities of the combined light output by the first string of BSY LEDs 11 and the combined light output by the second string of BSG LEDs 12. Those intensities, in turn, are a function of the drive currents that are supplied to the first and second strings 11, 12. For purposes of this example, it has been assumed that the first string 11 has a slightly higher intensity of light output than the second string 12. Based on this assumption, a point labeled 24 is provided on the graph of FIG. 4 that represents the color point of the light emitted by the combination of the first string of BSY LEDs 11 and the second string of BSG LEDs 12.

The color point of the overall light output of the device 10A will fall on a line 31 in FIG. 4 that extends between the color point of the combined light output of the third string of red or BSR LEDs 13 (i.e., point 23) and the color point of the combination of the light emitted by the first string of BSY LEDs 11 and the second string of BSG LEDs 12 (i.e., point 24). The exact location of that color point on line 31 will depend on the relative intensity of the light emitted by the strings 11 and 12 versus the intensity of the light emitted by string 13. In FIG. 4, the color point of the overall light output of the device 10A is labeled 28.

The device 10A may be designed, for example, to have a color point that falls on the point on the black-body locus 4 that corresponds to a color temperature of 3200K (this color point is labeled as point 27 in FIG. 4). However, due to manufacturing variations, blending and various other factors, the manufactured device may not achieve the designed color point, as is shown graphically in FIG. 4 where the point 28 that represents the color point of the manufactured device is offset by some distance from the black-body locus 4, and is near the point on the black-body locus corresponding to a correlated color temperature of 3800K as opposed to the desired color temperature of 3200K. Pursuant to embodiments of the present invention, the device 10A may be tuned to emit light that is closer to the desired color point 27 by adjusting the relative drive currents provided to the strings 11, 12, 13.

For example, pursuant to some embodiments, the color point of the light emitted by the combination of the first string of BSY LEDs 11 and the second string of BSG LEDs 12 may be moved along line 30 of FIG. 4 by adjusting the drive currents provided to one or both of BSY LED string 11 and BSG LED string 12. In particular, if the drive current provided to BSY LED string 11 is increased relative to the drive current supplied to BSG LED string 12, then the color point will move to the right from point 24 along line 30. If, alternatively, the drive current provided to BSY LED string 11 is decreased relative to the drive current supplied to BSG LED string 12, then the color point will move from point 24 to the left along line 30. In order to tune the device 10A to emit light having a color temperature of 3200K, the drive current provided to BSY LED string 11 is thus increased relative to the drive current supplied to BSG LED string 12 in an amount that moves the color point of the combined light emitted by BSY LED string 11 and BSG LED string 12 from point 24 to the point labeled 25 on line 30 of FIG. 4. As a result of this change, the color point of the overall light output by the device 10A moves from point 28 to point 26 on FIG. 4.

Next, the device 10A may be further tuned by adjusting the relative drive current provided to string 13 as compared to the drive currents provided to strings 11 and 12. In particular, the drive current provided to string 13 is increased relative to the drive current supplied to strings 11, 12 so that the light output by device 10A will move from color point 26 to the right along a line 32 that extends between point 23 and point 25 to point 27, thereby providing a device that outputs light having a color temperature of 3200K on the black-body locus 4. Thus, the above example illustrates how the drive current to the LED strings 11, 12, 13 can be tuned so that the device 10A outputs light at or near a desired color point. Such a tuning process may be used to reduce or eliminate deviations from a desired color point that result from, for example manufacturing variations in the output power, peak wavelength, phosphor thicknesses, phosphor conversion ratios and the like.

It will be appreciated in light of the discussion above that if a semiconductor light emitting device that includes independently controllable light sources that emit light at three different color points, then it may be theoretically possible to tune the device to any color point that falls within the triangle defined by the color points of the three light sources. Moreover, by selecting light sources having color points that fall on either side of the black-body locus 4, it may become possible to tune the device to a wide variety of color points along the black-body locus 4.

Figure 5A:
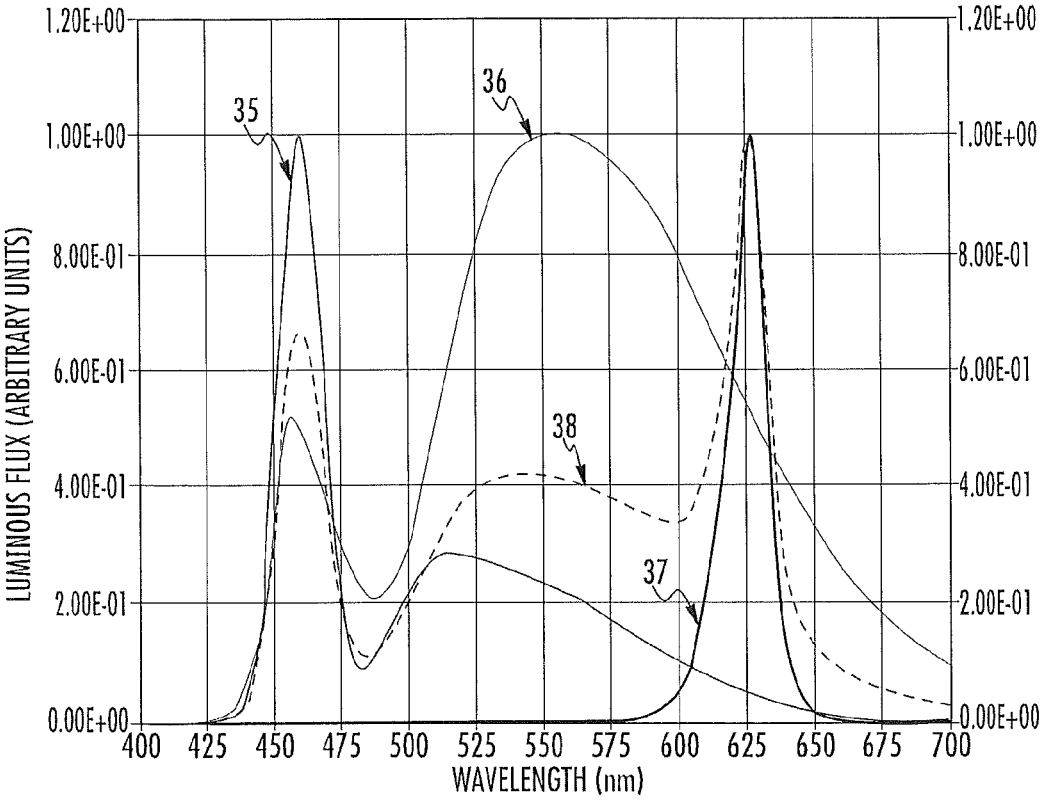
FIGS. 5A and 5B are graphs of the simulated spectral power distribution of a semiconductor light emitting device according to embodiments of the present invention.
Figure 5B:
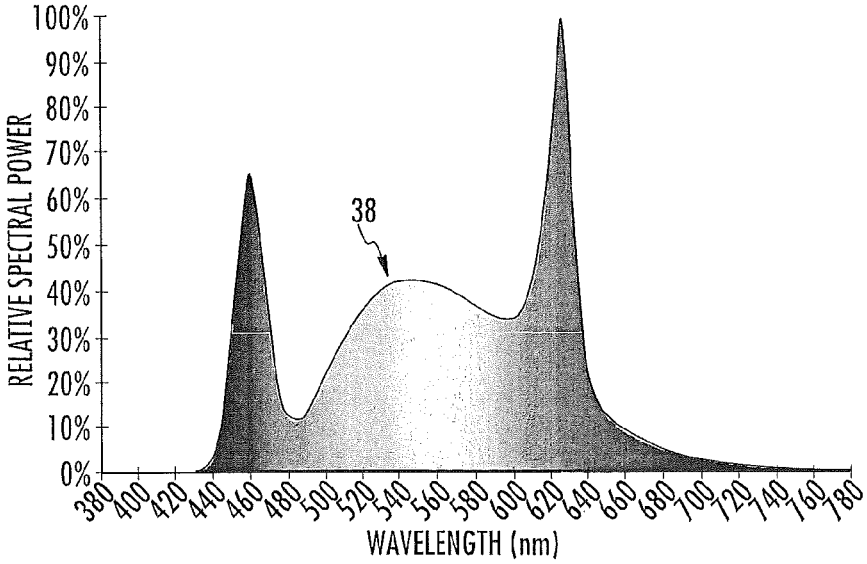

FIGS. 5A and 5B are graphs illustrating the simulated spectral power distribution of the semiconductor light emitting device having the general design of device 10A of FIG. 3. Curves 35, 36 and 37 of FIG. 5A illustrate the simulated contributions of each of the three LED strings 11, 12, 13 of the device 10A, while curve 38 illustrates the combined spectral output of all three strings 11, 12, 13. Each of curves 35, 36, 37 are normalized to have the same peak luminous flux. Curve 35 illustrates that the BSY LED string 11 emits light that is a combination of blue light from the blue LED(s) that is not converted by the recipient luminophoric medium(s) associated with the blue LED(s) and light having a peak wavelength in the yellow color range that is emitted by luminescent materials in those recipient luminophoric medium(s). Curve 36 similarly illustrates that the BSG LED string 12 emits light that is a combination of blue light from the blue LED(s) that is not converted by the recipient luminophoric medium(s) associated with the blue LED(s) and light having a peak wavelength in the green color range that is emitted by luminescent materials in those recipient luminophoric medium(s). Curve 37 illustrates that the red LED string 13 emits nearly saturated light having a peak wavelength of about 628 nm.

FIG. 5B illustrates curve 38 of FIG. 5A in a slightly different format. As noted above, curve 38 shows the luminous flux output by the device 10A of FIG. 3 as a function of wavelength. As shown in FIG. 5B, the light output by the device includes fairly high, sharp peaks in the blue and red color ranges, and a somewhat lower and broader peak that extends across the green, yellow and orange color ranges.

While the graph of FIG. 5B shows that the device 10A has significant output across the entire visible color range, a noticeable valley is present in the emission spectrum in the "cyan" color range that falls between the blue and green color ranges. For purposes of the present disclosure, the cyan color range is defined as light having a peak wavelength between 490 nm and 515 nm. Pursuant to additional embodiments of the present invention, semiconductor light emitting devices are provided that include one or more additional LEDs that "fill-in" this gap in the emission spectrum. Such devices may, in some cases, exhibit improved CRI Ra performance as compared to the device 10A of FIG. 3.

Figure 6:
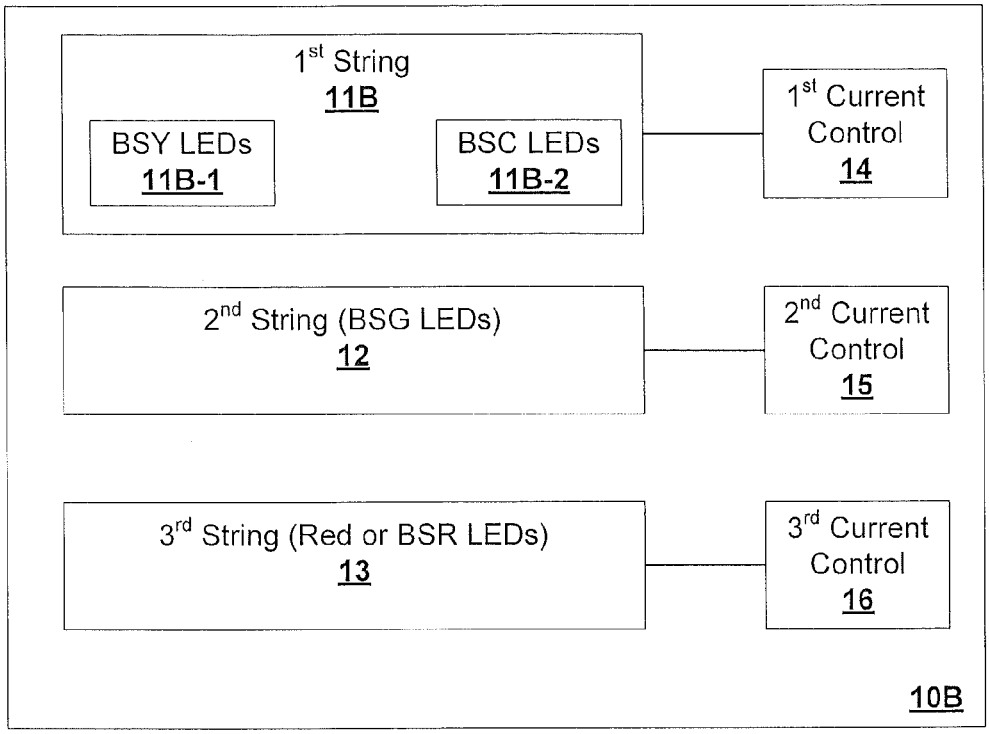
FIG. 6 is a schematic block diagram of a semiconductor light emitting device according to further embodiments of the present invention.

By way of example, FIG. 6 is a schematic block diagram of another semiconductor light emitting device 10B according to embodiments of the present invention. As can be seen by comparing FIGS. 3 and 6, the device 10B is identical to the device 10A of FIG. 3, except that the BSY LED string 11 of FIG. 3 is replaced with a string of LEDs 11B that includes one or more BSY LEDs 11B-1 and one or more LEDs that emit light having a peak wavelength in the cyan color range 11B-2. In the depicted embodiment, the LEDs 11-2 that emit light having a peak wavelength in the cyan color range are blue-shifted-cyan ("BSC") LEDs 11B-2 that each comprise a blue LED that includes a recipient luminophoric medium that emits light having a dominant wavelength between 490 and 515 nm. The BSC LEDs 11B-2 may help fill-in the above-referenced valley in the emission spectrum that would otherwise exist in the region between the blue peak that is formed by the emission from the blue LEDs in strings 11B-1 and 12 that is not converted by the recipient luminophoric mediums included on those LEDs and the emission of the phosphors in the recipient luminophoric mediums included on the BSG LEDs 12. As such, the CRI Ra value of the device may be increased.

It will be appreciated that many modifications can be made to the above-described semiconductor light emitting devices according to embodiments of the present invention, and to methods of operating such devices. For example, the device 10B of FIG. 6 could be modified so that the BSC LEDs 11B-2 were included as part of the BSG LED string 12 or the red LED string 13 instead of as part of the BSY LED string 11B. In still other embodiments, the BSC LEDs 11B-2 could be part of a fourth independently controlled string (which fourth string could have a fixed or independently adjustable drive current). In any of these embodiments, the BSC LEDs 11B-2 could be replaced or supplemented with one or more long blue wavelength LEDs that emit light having a peak wavelength between 471 nm and 489 nm.

Figure 7:
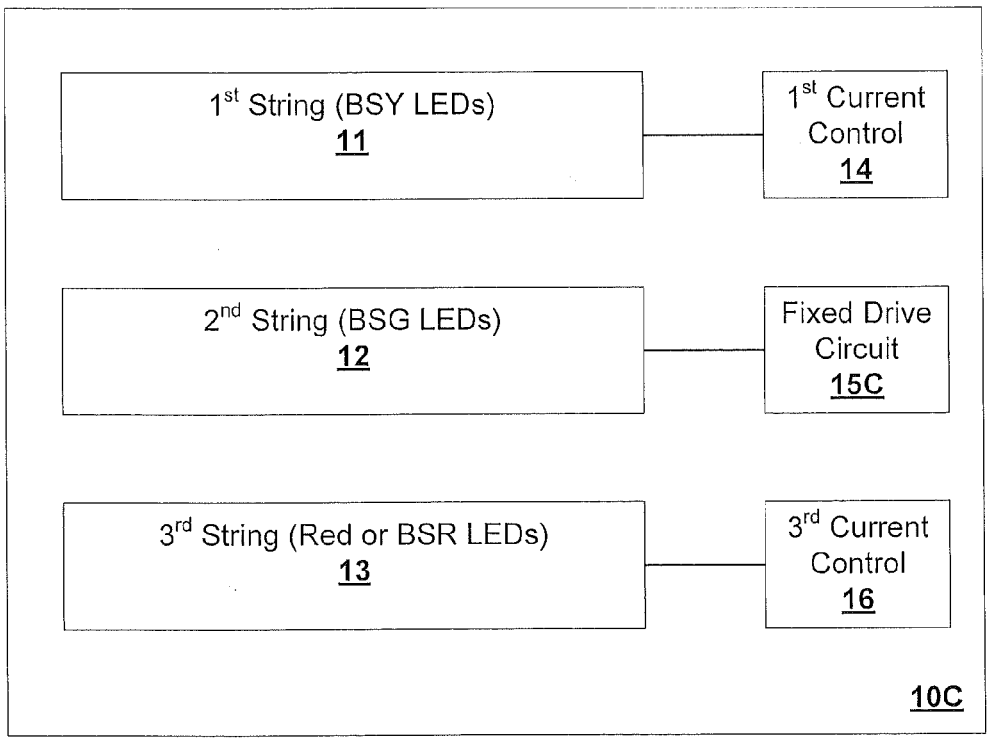
FIG. 7 is a schematic block diagram of a semiconductor light emitting device according to additional embodiments of the present invention.

It will also be appreciated that all of the strings 11, 12 and 13 need not be independently controllable in order to tune the device in the manner described above, For example, FIG. 7 illustrates a device 10C that is identical to the device 10A of FIG. 3, except that the second string control circuit 15 is replaced by a fixed drive circuit 15C that supplies a fixed drive current to the second BSG LED string 12. The color point of the combined output of the BSY LED string 11 and the BSG LED string 12 of device 10C is adjusted by using the first current control circuit 14 to increase or decrease the drive current provided to the BSY LED string 11 in order to move the color point of the combined output of the strings 11, 12 along the first line 30 of FIG. 4. However, it will be appreciated that independent control of all three strings 11, 12, 13 may be desired in some applications as this may allow the device to be tuned such that the output power of the device is maintained at or near a constant level during the tuning process.

Figure 8:
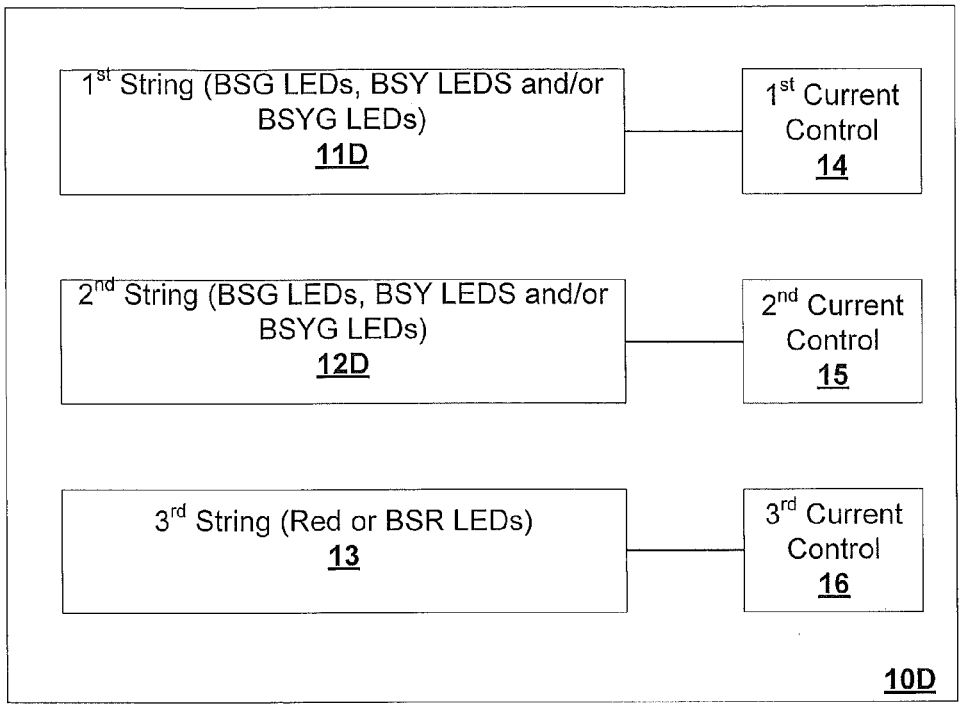
FIG. 8 is a schematic block diagram of a semiconductor light emitting device according to still further embodiments of the present invention.

As yet another example, FIG. 8 is a schematic block diagram of a semiconductor light emitting device 10D according to further embodiments of the present invention. As can be seen by comparing FIGS. 3 and 8, the device 10D may be identical to the device 10A of FIG. 3, except that (1) the BSY LED string 11 of FIG. 3 is replaced with a string of LEDs 11D that includes both BSG LEDs and BSY LEDs and/or "BSYG LEDs" 11D and (2) the LED string 12D likewise may include both BSG LEDs and BSY LEDs and/or BSYG LEDs. The term "BSYG LED" is used herein to refer to a blue LED that has an associated recipient luminophoric medium that includes both a first luminescent material that emits light having a peak wavelength that is within the yellow color range in response to light emitted by the blue LED and a second luminescent material that emits light having a peak wavelength that is within the green color range in response to light emitted by the blue LED. In some embodiments, the BSYG LED may be designed so that the blue LED and its associated recipient luminophoric medium together emit light having a color point that falls within a trapezoidal "BSYG region" on the 1931 CIE Chromaticity Diagram defined by the following x, y chromaticity coordinates: (0.30, 0.51), (0.37, 0.47), (0.29, 0.30), (0.23, 0.30), (0.30, 0.51).

It has been discovered that including both BSY and BSG LEDs (or BSYG LEDs) in one or both of the first and second strings may provide semiconductor light emitting devices that exhibit improved efficiency. In particular, LEDs may exhibit different efficiency levels as a function of drive current. If a target color point on the 1931 CIE Chromaticity Diagram has been selected for a particular semiconductor light emitting device, it may be preferable to have the color point of the combined output of the first string of LEDs (i.e., point 21 on FIG. 4) and the color point of the combined output of the second string of LEDs (i.e., point 22 on FIG. 4) when the LEDs in those strings are provided a drive current associated with a target efficiency to be about equidistant from the point (i.e., point 27 on FIG. 4) where the line defined by the color points for the combined light output of the first and second strings (i.e., line 30 on FIG. 4) intersects the line that extends between the desired color point on the black body locus and the color point of the third string of LEDs (i.e., line 32 on FIG. 4). If such a condition is met, then it may not be necessary to change the drive current supplied to either the first string of LEDs or the second string of LEDs very much from the drive currents that are associated with target efficiency levels for those LED strings. Thus, by carefully selecting the color points associated with the LEDs of two (or more) of the LED strings, the overall efficiency of the packaged semiconductor light emitting device may be improved while still achieving a desired color temperature and providing excellent color rendering properties.

In the embodiment of FIG. 8, it will be appreciated that the first string 11D may include all BSG LEDs, all BSY LEDs, all BSYG LEDs or combinations of two or all three types of LEDs. It will likewise be appreciated that the second string 12D may similarly include all BSG LEDs, all BSY LEDs, all BSYG LEDs or combinations of two or all three types of LEDs. Additional LEDs (e.g., long blue wavelength LEDs, BSC LEDs, etc. may also be added to either the first string 11D or the second string 12D without departing from the scope of the present invention.

As should be clear from the above discussion, embodiments of the present invention provide both a means for adjusting the light output of a packaged semiconductor light emitting device to have a desired color point on the 1931 CIE Chromaticity Diagram while achieving good color rendering properties, but also provide ways of operating at high efficiency levels. These goals may be achieved, for example, by selecting the LEDs to include in at least the first string of LEDs 11D and the second string of LEDs 12D such that the combined output of the first string of LEDs 11D and the second string of LEDs 12D when those strings are operated at a desired drive current level (which is typically a drive current level that provides good efficiency) is approximately on a line on the 1931 CIE Chromaticity Diagram that is defined by the color point for the combined output of the third string of LEDs 13 and a desired color point for the entire light output of the light emitting device. Once the LEDs are selected in this manner, then the process for the tuning the light output of the packaged semiconductor light emitting device that is described above with respect to FIG. 4 may be performed to adjust the color point of the light emitting device to the extent that is necessary. By preselecting the LEDs for each of the first and second strings in the manner discussed above, the amount of tuning necessary may typically be reduced and hence the LEDs that are included in the device may be operated closer to a desired drive current level that may be selected based on efficiency considerations.

In still further embodiments the second string 12D of LEDs that is included in the embodiment of FIG. 8 may be omitted, so that the semiconductor light emitting device includes only the first string of some combination of BSG LEDs, BSY LEDs and/or BSYG LEDs 11D and the third string of red LEDs 13 that are illustrated in FIG. 8. The first and third strings 11D, 13 may be independently controllable. If BSYG LEDs are included in the first string 11D, they may all have approximately the same color point or, alternatively, some of the BSYG LEDs may have substantially different color points than other of the BSYG LEDs. The same is true with respect to any pure BSY LEDs and/or pure BSG LEDs that are included in the first string of LEDs 11D.

In embodiments of the present invention that only include the first string of LEDs 11D and the third string of LEDs 13, the BSY LEDs, BSG LEDs and/or BSYG LEDs that are included in the first string of LEDs 11D may be selected so that a color point of the combined light output of the first string of LEDs 11D is on a line on the 1931 CIE Chromaticity Diagram that is defined by a color point of the third string of red LEDs 13 and a point associated with a desired correlated color temperature on the black body locus. The relative drive currents supplied to the first and third strings of LEDs 11D, 13 may then be adjusted to move the color point of the combined light output of both strings to a point on or about the black body locus, which point should be substantially at the desired correlated color temperature. Such designs provide less flexibility for adjusting the overall color point of the light emitting device (as they provide only two degrees of freedom), but may be suitable for many applications, particularly if the LEDs included in one or both of the strings are preselected to have a desired color point.

In the embodiments of the present invention described above, the tuning process started with the adjustment of the relative drive currents that are supplied to the first and second string of LEDs 11, 12. However, it will be appreciated that in other embodiments the tuning process need not start with this particular adjustment. For example, in another embodiment, the relative drive currents supplied to the BSY LED string 11 and the red LED string 13 may be adjusted first (which moves the color point for the overall light output of the device along a line 33 of FIG. 4), and then the relative drive current supplied to the BSG string 12 as compared to the drive currents supplied to the BSY LED string 11 and the red LED string 13 may be adjusted to move the color point of the device to a desired location. Similarly, in still another embodiment, the relative drive currents supplied to the BSG LED string 12 and the red LED string 13 may be adjusted first (which moves the color point for the overall light output of the device along a line 34 of FIG. 4), and then the relative drive current supplied to the BSY string 11 as compared to the drive currents supplied to the BSG LED string 12 and the red LED string 13 may be adjusted to move the color point of the device to a desired location.

It will likewise be appreciated that if more than three strings of LEDs are provided, an additional degree of freedom may be obtained in the tuning process. For example, if a fourth string of BSC LEDs was added to the device 10A of FIG. 3, then the device 10A could be tuned to a particular color point by appropriately adjusting any two of the four strings relative to the other strings.

Figure 9:
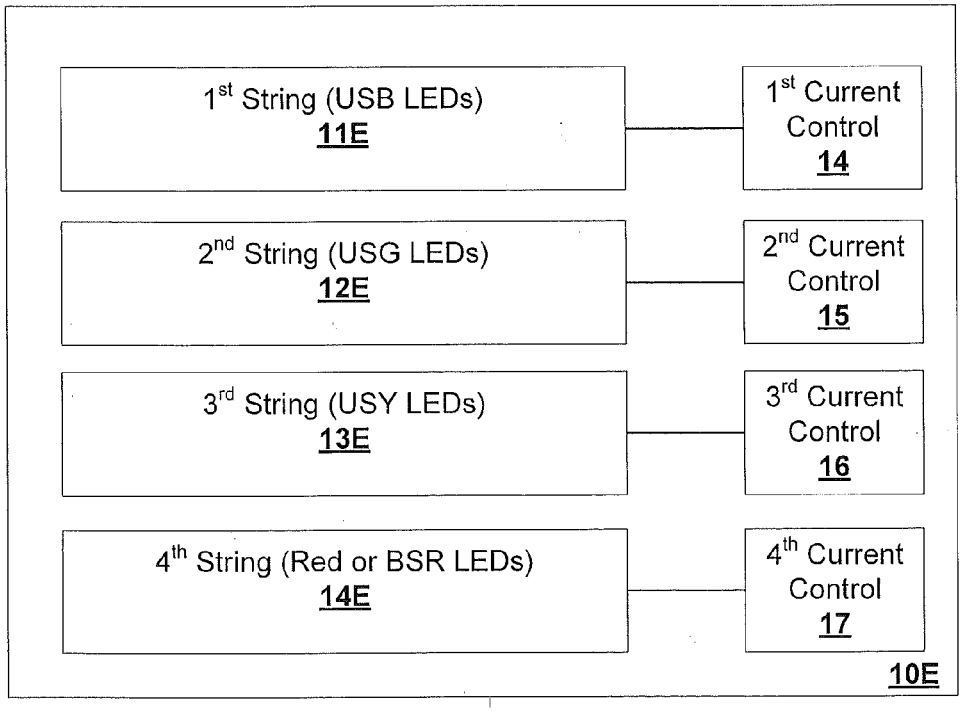
FIG. 9 is a schematic block diagram of a semiconductor light emitting device according to yet additional embodiments of the present invention.

It will likewise be appreciated that embodiments of the present invention are not limited to semiconductor devices that include BSY, BSG, BSC, BSYG, BSR and/or red LEDs. For example, FIG. 9 is a schematic block diagram of another semiconductor light emitting device 10E according to embodiments of the present invention that includes LEDs that emit radiation in the ultraviolet range. As shown in FIG. 9, the semiconductor light emitting device 10E includes a first string 11E of ultraviolet LEDs that have recipient luminophoric mediums that emit light in a blue color range (i.e., 400 to 490 nm) in response to the radiation emitted by the ultraviolet LEDs (herein such LEDs are referred to as ultraviolet shifted blue LEDs or "USB LEDs"), a second string 12E of ultraviolet LEDs that have recipient luminophoric mediums that emit light in a green color range (i.e., 500 to 570 nm) in response to the radiation emitted by the ultraviolet LEDs (herein such LEDs are referred to as ultraviolet shifted green LEDs or "USG LEDs"), a third string 13E of ultraviolet LEDs that have recipient luminophoric mediums that emit light in the yellow color range (i.e., 571 to 599 nm) in response to the radiation emitted by the ultraviolet LEDs (herein such LEDs are referred to as ultraviolet shifted yellow LEDs or "USY LEDs"), and a fourth string 14E of orange and/or red LEDs.

In still other embodiments, the light emitting device 10E of FIG. 9 may be further modified. For example, the second string 12E of LEDs may alternatively be, for example, BSG LEDs or other LEDs that emit light in the green color range (e.g., a blue LED with a luminophoric medium that includes luminescent materials that emit light having a color point within the green region of the 1931 CE Chromaticity Diagram that is outside the BSG LED region on the 1931 CE Chromaticity Diagram). As another example, the third string 13E of LEDs may alternatively be BSY LEDs or other LEDs that emit light in the yellow color range (e.g., a blue LED with a luminophoric medium that includes luminescent materials that emit light having a color point within the yellow region of the 1931 CE Chromaticity Diagram that is outside the BSY LED region on the 1931 CE Chromaticity Diagram). It will also be appreciated, that luminescent materials that emit in color ranges other than yellow and green may be used (e.g., the second string of LEDs 12E could instead include BSC LEDs). Thus, it will be appreciated that the above-described embodiments are exemplary in nature and do not limit the scope of the present invention.

As noted above, in some embodiments, the second string 12E of LEDs may be blue LEDs that each have a luminophoric medium that includes luminescent materials that emit light having a color point that is generally green in color, but the color point is outside the BSG LED region on the 1931 CE Chromaticity Diagram. In these embodiments, the color point may be within at least eight MacAdam ellipses from one or more points that are within the BSG LED region. In other example embodiments, the color point may be within at least five MacAdam ellipses from one or more points that are within the BSG LED region. Similarly, the third string 13E of LEDs may be blue LEDs that each have a luminophoric medium that includes luminescent materials that emit light having a color point that is generally yellow in color, but the color point is outside the BSY LED region on the 1931 CE Chromaticity Diagram. In these embodiments, the color point may be within at least eight MacAdam ellipses from one or more points that are within the BSY LED region. In other example embodiments, the color point may be within at least five MacAdam ellipses from one or more points that are within the BSY LED region. Such LEDs may also be used in the first and/or second LED strings 11D, 12D of the light emitting device 10D of FIG. 8.

In some embodiments, the LEDs in the third string 13 of FIGS. 3 and 6-8 may emit light having a dominant wavelength between 600 nm and 635 nm, or even within a range of between 610 nm and 625 nm. Likewise, in some embodiments, the blue LEDs that are used to form the BSY LEDs, BSG LEDs and/or BSYG LEDs of the devices of FIGS. 3 and 6-8 may have peak wavelengths that are between about 430 nm and 480 nm, or even within a range of between 440 nm and 475 nm. In some embodiments, the BSG LEDs may comprise a blue LED that emits radiation having a peak wavelength between 440 and 475 nm and an associated recipient luminophoric medium that together emit light having a color point that falls within the region on the 1931 CIE Chromaticity Diagram defined by the following x, y chromaticity coordinates: (0.35, 0.48), (0.26, 0.50), (0.13, 0.26), (0.15, 0.20), (0.26, 0.28), (0.35, 0.48).

FIG. 10A is a table that lists design details for eight semiconductor light emitting devices according to embodiments of the present invention. FIG. 10B is a table that provides information regarding the simulated spectral emissions of each of the eight devices of FIG. 10A.

As shown in FIG. 10A, eight semiconductor light emitting devices were designed that each had the basic configuration of the device 10A of FIG. 3 in that they included a string of BSY LEDs, a string of BSG LEDs and a string of red LEDs. These devices were designed to have target correlated color temperatures of 2700K, 3000K, 3500K, 4000K, 4500K, 5500K, 5700K and 6500K, respectively, on the black body locus 4 of FIG. 1. In the table of FIG. 10A, the column labeled "Trapezoid" provides the (x,y) color coordinates on the 1931 CIE Chromaticity Diagram that define a trapezoid around the target color point that would be considered acceptable for each particular design, the column labeled "Center Point" provides the coordinates of the center of this trapezoid, and the column labeled "Center Point CCT" provides the correlated color temperature of the center point.

FIG. 10B provides information regarding the simulated spectral emissions of each of the eight devices of FIG. 10A. As shown in FIG. 10B, these simulations indicate that all of the devices should provide a CRI Ra of 94 or greater, which represents excellent color rendering performance. Additionally, the luminous efficacy of each device varies between 310 and 344 Lum/W-Optical, which again represents excellent performance. FIG. 10B also breaks down the simulated contribution of each of the BSY LED, BSG LED and red LED strings 11, 12, 13 to the overall luminous output of the device. As can be seen, the red and yellow contributions decrease with increasing correlated color temperature. Finally, FIG. 10B also provides the color coordinates of the combined light output by BSY LED string 11 and BSG LED string 12.

Figure 11A:
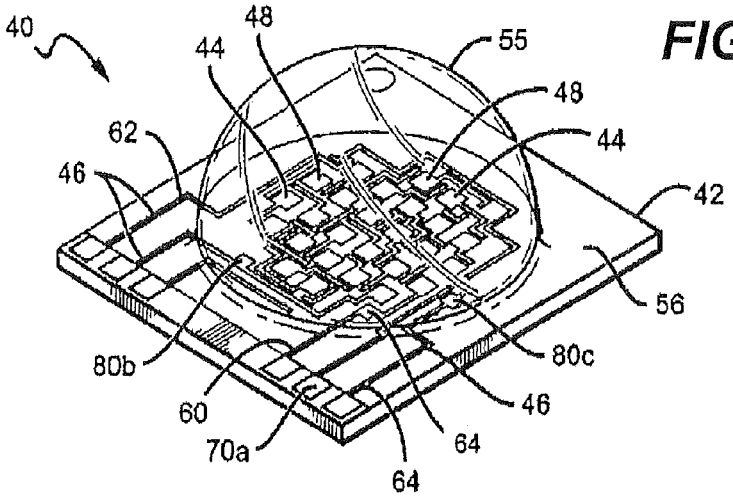
FIGS. 11A-E are various views of a packaged semiconductor light emitting device according to certain embodiments of the present invention.
Figure 11B:
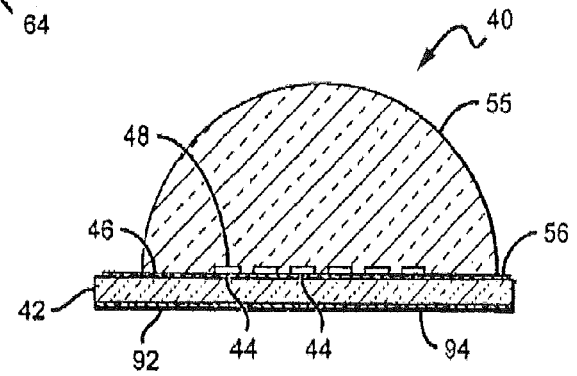
Figure 11C:
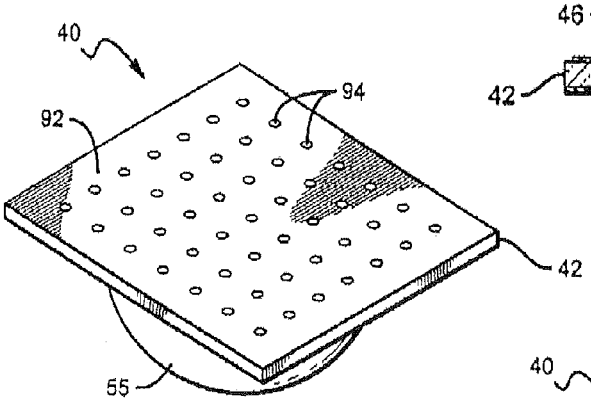
Figure 11D:
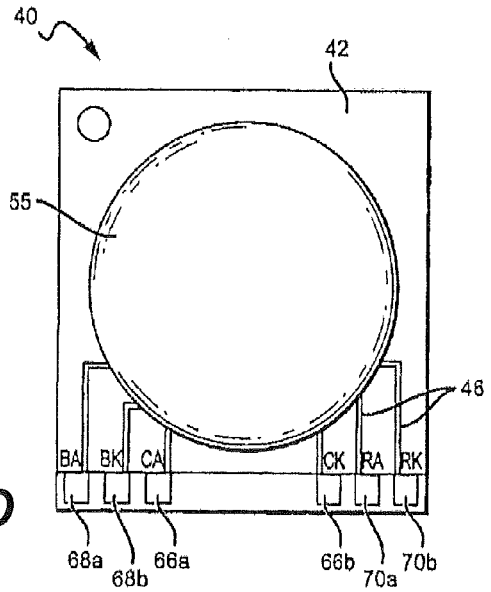
Figure 11E:
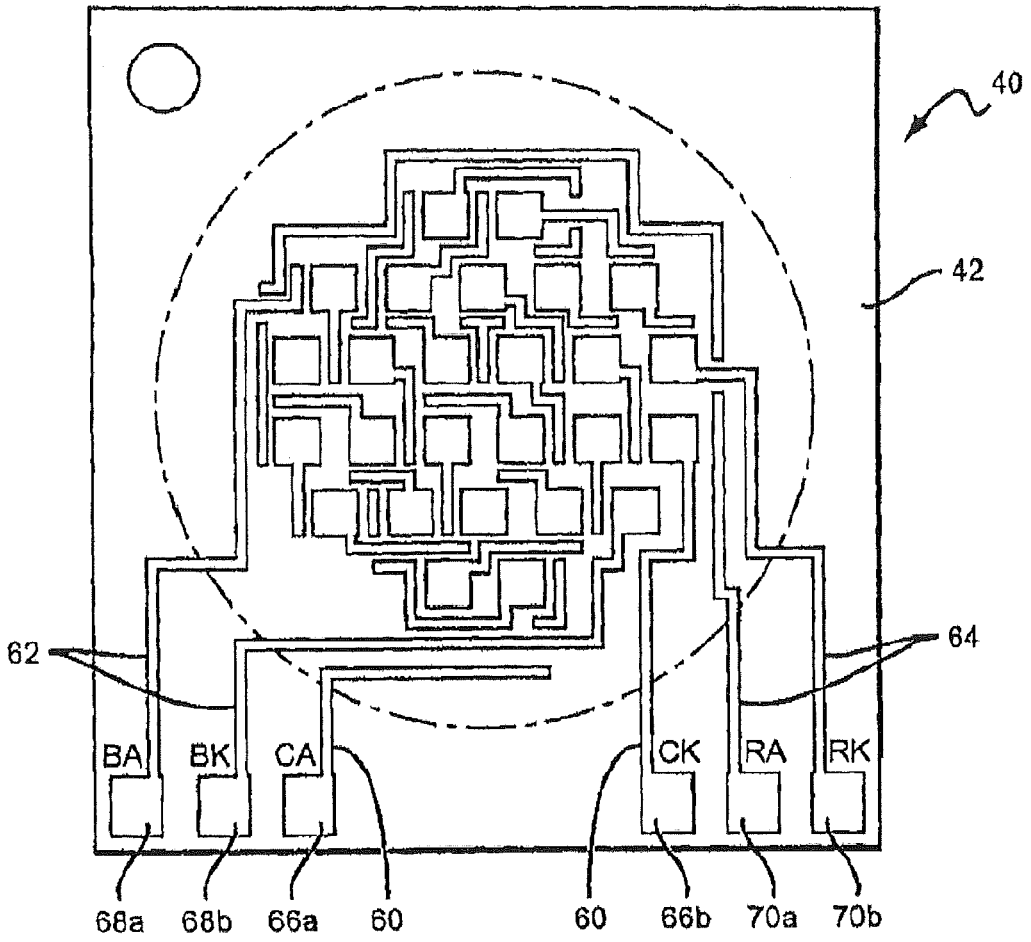

A packaged semiconductor light emitting device 40 according to embodiments of the present invention will now be described with reference to FIGS. 11A-E. FIG. 11A is a top perspective view of the device 40. FIG. 11B is a side cross-sectional view of the device 40. FIG. 11C is a bottom perspective view of the device 40. FIG. 11D is a top plan view of the device 40. FIG. 11E is a top plan view of a die attach pad and interconnect trace arrangement for the device 40.

As shown in FIG. 11A, the device 40 includes a submount 42 that supports an array of LEDs 48. The submount 40 can be formed of many different materials including either insulating materials, conductive materials or a combination thereof. For example, the submount 42 may be formed of alumina, aluminum oxide, aluminum nitride, silicon carbide, organic insulators, sapphire, copper, aluminum, steel, other metals or metal alloys, silicon, or of a polymeric material such as polyimide, polyester, etc. In some embodiments, the submount 42 may comprise a printed circuit board (PCB), which may facilitate providing electrical connections to and between the LEDs 48. Portions of the submount 42 may include or be coated with a high reflective material, such as reflective ceramic or metal (e.g., silver) to enhance light extraction from the packaged device 40.

Each LED 48 is mounted to a respective die pad 44 that is provided on the top surface of the submount 42. Conductive traces 46 are also provided on the top surface of the submount 42. The die pads 44 and conductive traces 46 can comprise many different materials such as metals (e.g., copper) or other conductive materials, and may be deposited, for example, via plating and patterned using standard photolithographic processes. Seed layers and/or adhesion layers may be provided beneath the die pads 44. The die pads 44 may also include or be plated with reflective layers, barrier layers and/or dielectric layers. The LEDs 48 may be mounted to the die pads 44 using conventional methods such as soldering.

In some embodiments, the LEDs 48 may include one or more BSY LEDs, one or more BSG LEDs and one or more saturated red LEDs. In other embodiments, some or all of the saturated red LEDs may be replaced with BSR LEDs. Moreover, additional LEDs may be added, including, for example, one or more long-wavelength blue LEDs and/or BSC LEDs. LED structures, features, and their fabrication and operation are generally known in the art and only briefly discussed herein.

Each LED 48 may include at least one active layer/region sandwiched between oppositely doped epitaxial layers. The LEDs 48 may be grown as wafers of LEDs, and these wafers may be singulated into individual LED dies to provide the LEDs 48. The underlying growth substrate can optionally be fully or partially removed from each LED 48. Each LED 48 may include additional layers and elements including, for example, nucleation layers, contact layers, current spreading layers, light extraction layers and/or light extraction elements. The oppositely doped layers can comprise multiple layers and sub-layers, as well as super lattice structures and interlayers. The active region can include, for example, single quantum well (SQW), multiple quantum well (MQW), double heterostructure and/or super lattice structures. The active region and doped layers may be fabricated from various material systems, including, for example, Group-III nitride based material systems such as GaN, aluminum gallium nitride (AlGaN), indium gallium nitride (InGaN) and/or aluminum indium gallium nitride (AlInGaN). In some embodiments, the doped layers are GaN and/or AlGaN layers, and the active region is an InGaN layer.

Each LED 48 may include a conductive current spreading structure on its top surface, as well as one or more contacts/bond pads that are accessible at its top surface for wire bonding. The current spreading structure and contacts/bond pads can be made of a conductive material such as Au, Cu, Ni, In, Al, Ag or combinations thereof, conducting oxides and transparent conducting oxides. The current spreading structure may comprise spaced-apart conductive fingers that are arranged to enhance current spreading from the contacts/bond pads into the top surface of its respective LED 48. In operation, an electrical signal is applied to a contact/bond pad through a wire bond, and the electrical signal spreads through the fingers of the current spreading structure into the LED 48.

Some or all of the LEDs 48 may have an associated recipient luminophoric medium that includes one or more luminescent materials. Light emitted by a respective one of the LEDs 48 may pass into its associated recipient luminophoric medium. At least some of that light that passes into the recipient luminophoric medium is absorbed by the luminescent materials contained therein, and the luminescent materials emit light having a different wavelength distribution in response to the absorbed light. The recipient luminophoric medium may fully absorb the light emitted by the LED 48, or may only partially absorb the light emitted by the LED 48 so that a combination of unconverted light from the LED 48 and down-converted light from the luminescent materials is output from the recipient luminophoric medium. The recipient luminophoric medium may be coated directly onto the LED or otherwise disposed to receive some or all of the light emitted by its respective LED 48. It will also be appreciated that a single recipient luminophoric medium may be used to down-convert some or all of the light emitted by multiple of the LEDs 48. By way of example, in some embodiments, each string of LEDs 48 may be included in its own package, and a common recipient luminophoric medium for the LEDs 48 of the string may be coated on a lens of the package or included in an encapsulant material that is disposed between the lens and the LEDs 48.

The above-described recipient luminophoric mediums may include a single type of luminescent material or may include multiple different luminescent materials that absorb some of the light emitted by the LEDs 48 and emit light in a different wavelength range in response thereto. The recipient luminophoric mediums may comprise a single layer or region or multiple layers or regions, which may be directly adjacent to each other or spaced-apart. Suitable methods for applying the recipient luminophoric mediums to the LEDs 48 include the coating methods described in U.S. patent application Ser. Nos. 11/656,759 and 11/899,790, the electrophoretic deposition methods described in U.S. patent application Ser. No. 11/473,089, and/or the spray coating methods described in U.S. patent application Ser. No. 12/717,048. Numerous other methods for applying the recipient luminophoric mediums to the LEDs 48 may also be used.

As noted above, in certain embodiments, the LEDs 48 can include at least one BSY LED, at least one BSG LED, and at least one red light source. The BSY LED(s) may comprise blue LEDs that include a recipient luminophoric medium that has YAG:Ce phosphor particles therein such that the LED and phosphor particles together emit a combination of blue and yellow light. In other embodiments, different yellow light emitting luminescent materials may be used to form the BSY LEDs including, for example, phosphors based on the (Gd, Y)$_3$(Al, Ga)$_5$O$_{12}$:Ce system, such as $Y_3Al_5O_{12}$:Ce (YAG) phosphors; $Tb_{3-x}RE_xO_{12}$:Ce (TAG) phosphors where RE=Y, Gd, La, Lu; and/or $Sr_{2-x-y}Ba_xCa_ySiO_4$:Eu phosphors. The BSG LED(s) may comprise blue LEDs that have a recipient luminophoric medium that include LuAG:Ce phosphor particles such that the LED and phosphor particles together emit a combination of blue and green light. In other embodiments, different green light emitting luminescent materials may be used including, for example, (Sr,Ca,Ba) (Al,Ga)$_2$S$_4$: $Eu^{2+}$ phosphors; $Ba_2(Mg,Zn)Si_2O_7$: $Eu^{2+}$ phosphors; $Gd_{0.46}Sr_{0.31}Al_{1.23}O_xF_{1.38}$:$Eu^{2+}{}_{0.06}$ phosphors; $(Ba_{1-x-y}Sr_xCa_y)SiO_4$:Eu phosphors; $Ba_xSiO_4$:$Eu^{2+}$ phosphors; $Sr_6P_5BO_{20}$:Eu phosphors; $MSi_2O_2N_2$:$Eu^{2+}$ phosphors; and/or Zinc Sulfide:Ag phosphors with (Zn,Cd)S:Cu:Al. In some embodiments, the BSG LEDs may employ a recipient luminescent medium that includes a green luminescent material that has a FWHM emission spectrum that falls at least in part into the cyan color range (and in some embodiments, across the entire cyan color range) such as, for example, a LuAG:Ce phosphor that has a peak emission wavelength of between 535 and 545 nm and a FWHM bandwidth of between about 110-115 nm. The at least one red light source may comprise BSG LEDs and/or red LEDs such as, for example, conventional AlInGaP LEDs. Suitable luminescent materials for the BSR LEDs (if used) include $Lu_2O_3$:$Eu^{3+}$ phosphors; $(Sr_{2-x}La_x)(Ce_{1-x}Eu_x)O_4$ phosphors; $Sr_2Ce_{1-x}Eu_xO_4$ phosphors; $Sr_{2-x}Eu_xCeO_4$ phosphors; $SrTiO_3$:$Pr^{3+}$,$Ga^{3+}$ phosphors; $(Ca_{1-x}Sr_x)SiAlN_3$:$Eu^{2+}$ phosphors; and/or $Sr_2Si_5N_8$:$Eu^{2+}$ phosphors. It will be understood that many other phosphors can used in combination with desired solid state emitters (e.g., LEDs) to achieve the desired aggregated spectral output.

An optical element or lens 55 may be provided over the LEDs 48 to provide environmental and/or mechanical protection. In some embodiments the lens 55 can be in direct contact with the LEDs 48 and a top surface of the submount 42. In other embodiments, an intervening material or layer may be provided between the LEDs 48 and the top surface of the submount 42. The lens 55 can be molded using different molding techniques such as those described in U.S. patent application Ser. No. 11/982,275. The lens 55 can be many different shapes such as, for example, hemispheric, ellipsoid bullet, flat, hex-shaped, and square, and can be formed of various materials such as silicones, plastics, epoxies or glass. The lens 55 can be textured to improve light extraction. For a generally circular LED array, the diameter of the lens can be approximately the same as or larger than the diameter of the LED array.

The lens 55 may also include features or elements arranged to diffuse or scatter light, including scattering particles or structures. Such particles may include materials such as titanium dioxide, alumina, silicon carbide, gallium nitride, or glass micro spheres, with the particles preferably being dispersed within the lens. Alternatively, or in combination with the scattering particles, air bubbles or an immiscible mixture of polymers having a different index of refraction could be provided within the lens or structured on the lens to promote diffusion of light. Scattering particles or structures may be dispersed homogeneously throughout the lens 55 or may be provided in different concentrations or amounts in different areas in or on a lens. In one embodiment, scattering particles may be provided in layers within the lens, or may be provided in different concentrations in relation to the location of LEDs 48 (e.g., of different colors) within the packaged device 40. In other embodiments, a diffuser layer or film (not shown) may be disposed remotely from the lens 55 at a suitable distance from the lens 55, such as, for example, 1 mm, 5 mm, 10 mm, 20 mm, or greater. The diffuser film may be provided in any suitable shape, which may depend on the configuration of the lens 55. A curved diffuser film may be spaced apart from but conformed in shape to the lens and provided in a hemispherical or dome shape.

The LED package 40 may include an optional protective layer 56 covering the top surface of the submount 42, e.g., in areas not covered by the lens 55. The protective layer 56 provides additional protection to the elements on the top surface to reduce damage and contamination during subsequent processing steps and use. The protective layer 56 may be formed concurrently with the lens 55, and optionally comprise the same material as the lens 55.

As shown in FIGS. 11D-E, the packaged device 40 includes three contact pairs 66*a*-66*b*, 68*a*-68*b*, 70*a*-70*b* that provide external electrical connections. Three current control circuits, such as current control circuits 14, 15, 16 of FIG. 3 (not shown in FIGS. 11A-E) may also be provided. As shown in FIG. 11E, traces 60, 62, 64 (which are only partly visible since some of these traces pass to the lower side of the submount 42) couple the contact pairs to the individual LEDs 48. As discussed above, in some embodiments, the LEDs 48 may be arranged in three strings, with the LEDs 48 in each string connected in series. In one embodiment, two strings can include up to ten LEDs each, and the other string may include up to eight LEDs, for a total of up to twenty-eight LEDs operable in three separate strings.

The current control circuits 14, 15, 16 (see, e.g., FIG. 3; not shown in FIGS. 11A-E) may be used to independently control the drive current that is supplied to each of the three LED strings via traces 60, 62, 64. As discussed above, the drive currents may be separately adjusted to tune the combined light output of the packaged device 40 to more closely approximate a target color point, even when the individual LEDs 48 may deviate to some degree from output light color coordinates and/or lumen intensities that are specified in the design of device 40. Various control components known in the art may be used to effectuate separate control of the drive currents provided to the three strings of LEDs via traces 60, 62, 64, and hence additional discussion thereof will be omitted here.

To promote heat dissipation, the packaged device 40 may include a thermally conductive (e.g., metal) layer 92 on a bottom surface of the submount 42. The conductive layer 92 may cover different portions of the bottom surface of the submount 42; in one embodiment as shown, the metal layer 92 may cover substantially the entire bottom surface. The conductive layer 92 may be in at least partial vertical alignment with the LEDs 48. In one embodiment, the conductive layer is not in electrical communication with elements (e.g., LEDs) disposed on top surface of the submount 42. Heat that may concentrate below individual LEDs 48 will pass into the submount 42 disposed directly below and around each LED 48. The conductive layer 92 can aid heat dissipation by allowing this heat to spread from concentrated areas proximate the LEDs into the larger area of the layer 92 to promote dissipation and/or conductive transfer to an external heat sink (not shown). The conductive layer 92 may include holes 94 providing access to the submount 42, to relieve strain between the submount 42 and the metal layer 92 during fabrication and/or during operation. In certain embodiments, thermally conductive vias or plugs that pass at least partially through the submount 42 and are in thermal contact with the conductive layer 92 may be provided. The conductive vias or plugs promote passage of heat from the submount 42 to the conductive layer 92 to further enhance thermal management.

While FIGS. 11A-E illustrate one exemplary package configuration for light emitting devices according to embodiments of the present invention, it will be appreciated that any suitable packaging arrangement may be used. In some embodiments, each string of one or more LEDs may be provided in its own package, and the packages for each string are then mounted together on a submount. A diffuser may be provided that receives light emitted by each package and mixes that light to provide an output having the desired color point.

Figure 12:
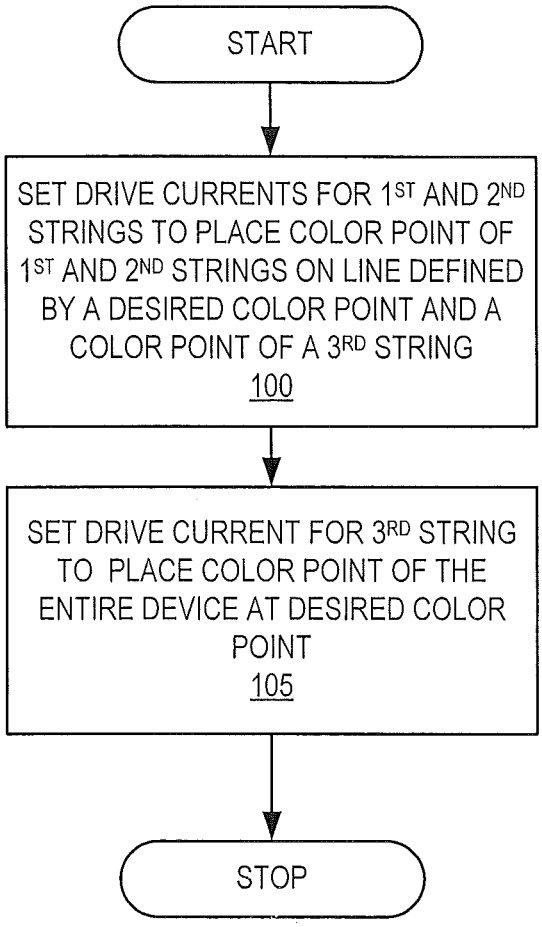
FIG. 12 is a flowchart illustrating operations for tuning a semiconductor light emitting device according to embodiments of the present invention.

Methods of tuning a multi-emitter semiconductor light emitting device to a desired color point according to embodiments of the present invention will now be further described with respect to the flow chart of FIG. 12.

As shown in FIG. 12, operations may begin with the relative drive currents provided to a first string of at least one light emitting diode ("LED") and to a second string of at least one LED being set so that the color point on the 1931 CIE Chromaticity Diagram of the combined output of the first string and the second string is approximately on a line that extends on the 1931 CIE Chromaticity Diagram through the desired color point and a color point of a combined output of a third string of at least one LED (block 100). Then, a drive current that is provided to the third string of at least one LED is set so that the color point on the 1931 CIE Chromaticity Diagram of the combined output of the packaged multi-emitter semiconductor light emitting device is approximately at the desired color point (block 105).

In some embodiments, the first string of LEDs may include at least one BSY LED, and the second string of LEDs may include at least one BSG LED. The third string of at least one LED may include at least one red LED and/or at least one BSR LED. The color point on the 1931 CIE Chromaticity Diagram of the combined output of the multi-emitter semiconductor light emitting device may be within three MacAdam ellipses from a selected color point on the black-body locus.

In some embodiments of the present invention, the drive currents supplied to the strings may be set in the fashion described above at the factory in order to tune the device to a particular color point. In some cases, adjustable resistors or resistor networks, digital to analog converters with flash memory, and/or fuse link diodes may then be set to fixed values so that the packaged semiconductor light emitting device will be set to emit light at or near the desired color point.

According to further embodiments of the present invention, semiconductor light emitting devices may be provided which allow an end user to set the color point of the device. For example, in some embodiments, semiconductor light emitting devices may be provided that include at least two different color temperature settings. By way of example, a device might have a first setting at which the drive currents to various strings of light emitting devices that are included in the device are set to provide a first light output having a color temperature of between 4000K and 5000K, which end users may prefer in the daytime, and a second light output having a color temperature of between 2500K and 3500K, which users may prefer at night.

Figure 13:
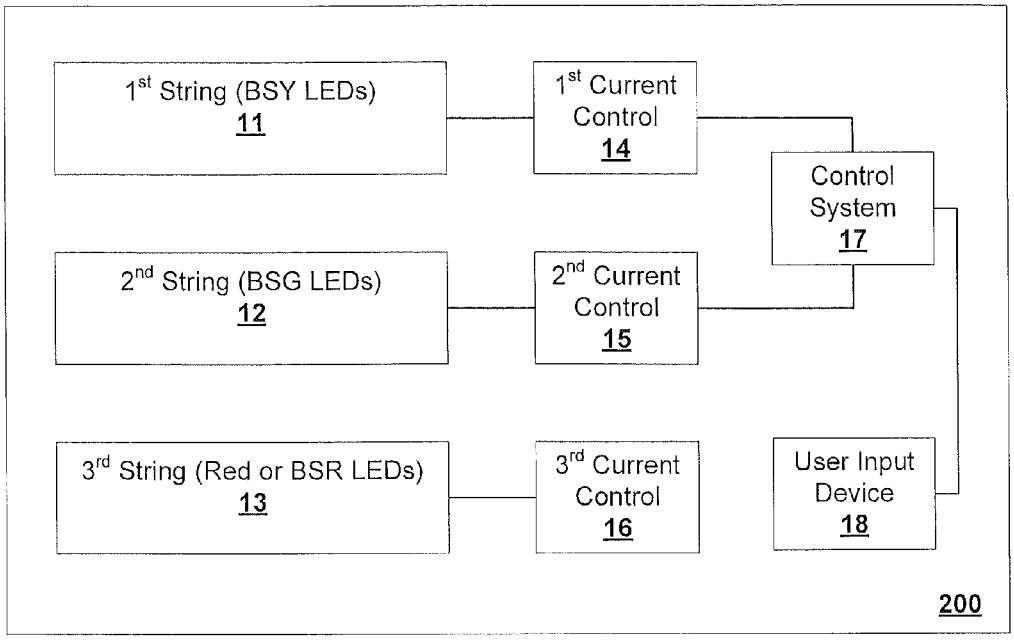
FIG. 13 is a schematic diagram of a semiconductor light emitting devices having user-selectable color points according to certain embodiments of the present invention.

FIG. 13 illustrates a packaged semiconductor light emitting device 200 according to certain embodiments of the present invention that is configured so that an end user may adjust the color point of the light output by the device 200. The particular device 200 depicted in FIG. 13 takes advantage of the fact that BSY LEDs and BSG LEDs may be selected such that a first color point that represents the output of a BSY LED string and a second color point that represents the output of a BSG LED string may define a line that runs generally parallel to the black-body locus 4, as is apparent from FIG. 2. As such, by adjusting the relative drive currents supplied to a BSY LED string and a BSG LED string, it may be possible for an end user to adjust the color point of the device 200 to move more or less along a selected portion of the black-body locus 4. Moreover, it has been discovered that at warmer color temperatures, the emissions from a string of BSY LEDs and red LEDs may generate light having both high CRI Ra values and good luminous efficiency. Likewise, at cooler color temperatures, the emissions from a string of BSG LEDs and red LEDs may generate light having both high CRI Ra values and good luminous efficiency. Similar results may be achieved with the use of LED strings that include BSYG LEDs or combinations of BSG, BSY and/or BSYG LEDs, as well as with LED strings that include LEDs that fall just outside the BSG and BSY regions, such as LEDs having color points that fall outside both the BSY and BSG regions but that are within eight MacAdam ellipses of at least one point within the BSY region or BSG region. Thus, it will be appreciated that the user input device 18 and control system 17 of FIG. 13 (which are described below) may be added in a similar fashion to any of the embodiments of the present invention discussed above to provide yet additional embodiments of the present invention.

Turning to the particular embodiment depicted in FIG. 13, it can be seen that the device 200 includes a first string of BSY LEDs 11, a second string of BSG LEDs 12, and a third string of red-light emitting LEDs 13. The device 200 also includes first, second and third current control circuits 14, 15, 16, which were described above with respect to FIG. 3. The device 200 further includes a user input device 18 which could comprise, for example, a knob, slider bar or the like that are commonly used as dimming elements on conventional dimmer switches for incandescent lights. When an end user adjusts the position of this input device, a control signal is generated that is provided to a control system 17. In response to this control signal, the control system 17 sends control signals to one or both of the first and second current control circuits 14, 15 which cause one or both of those circuits to adjust their output drive currents in a fashion that changes the relative levels of the drive currents supplied to BSY LED string 11 and BSG LED string 12. By adjusting these relative drive current levels, the combined output of the strings 11 and 12 moves along a line defined by the color point of string 11 and the color point of string 12. As noted above, the device 200 may be designed so that this line runs generally parallel to the black-body locus 4. So long as the drive current supplied by the third control circuit 16 is factory set to place the color point of the combined output of the device 200 at or near the black body locus, the end user may use the user input device 18 to change the color temperature of the device 200 over a fairly broad range (e.g., 2800 K to 6500 K) while still keeping the color point of the device 200 on or near the black body locus 4. It will also be appreciated that in some embodiments the control system 17 may be omitted and the output signal(s) from the user input device 18 may be used to directly control the first and second current control circuits 14, 15.

A wide variety of changes may be made to the device 200 of FIG. 13. For example, in other embodiments, an end user could be provided input devices that allow control of the relative drive currents of (1) string 11 to string 12 and (2) the combination of strings 11 and 12 to string 13. In such embodiments, the end user can control the device 200 to emit light over a much wider range of color points. In a further embodiment, the end user could be provided independent control of the drive current to each of strings 11, 12 and 13. In still other embodiments, the user input device 18 could be a multi-position switch (e.g., 2 to 6 positions), where each position corresponds to drive current for each string 11, 12, 13 that provides light having a pre-set color point (e.g., pre-set color points 500K or 1000K apart along the black-body locus 4). The various modifications described above may be combined in different ways to provide yet additional embodiments.

According to still further embodiments of the present invention, tunable multi-emitter semiconductor light emitting devices are provided which automatically adjust the drive currents provided to one or more of multiple strings of light emitting devices included therein. By way of example, it is known that when LEDs constructed using different semiconductor material systems (e.g., GaN-based LEDs, InAlGaP-based LEDs and/or organic LEDs) are used in the same light emitting device, the characteristics of the LEDs may vary differently with operating temperature, over time, etc. As such, the color point of the light produced by such devices is not necessarily stable. Pursuant to further embodiments of the present invention, tunable packaged multi-emitter semiconductor light emitting devices are provided with automatically adjusting drive currents that compensate for such variable changes. The automatic adjustment may, for example, be pre-programmed or responsive to sensors.

Figure 14:
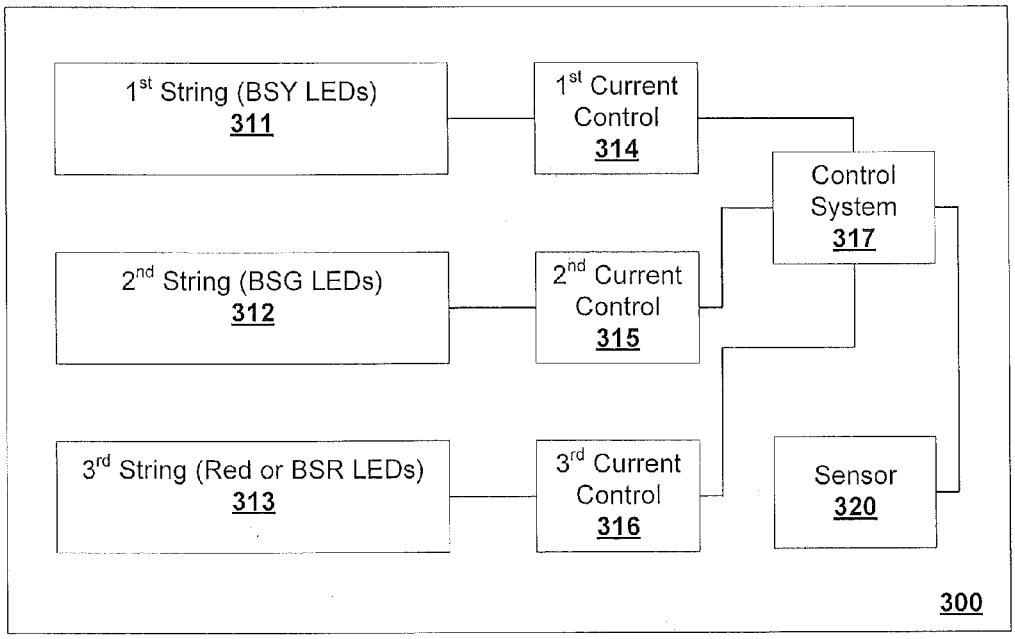
FIG. 14 is a schematic diagram of a semiconductor light emitting devices having automatically adjustable color points according to certain embodiments of the present invention.

FIG. 14 is a schematic block diagram of a tunable multi-emitter semiconductor light emitting device 300 that is configured to automatically adjust the drive currents provided to the LED strings included therein. As shown in FIG. 14, the device 300 includes a first string of LEDs 311, a second string of LEDs 312, and a third string of LEDs 313. In some embodiments, the first string 311 may comprise one or more BSY LEDs, the second string 312 may comprise one or more BSG LEDs, and the third string 313 may comprise one or more red LEDs and/or one or more BSR LEDs.

The device 300 also includes first, second and third current control circuits 314, 315, 316. The first, second and third current control circuits 314, 315, 316 are configured to provide respective drive currents to the first, second and third strings of LEDs 311, 312, 313, and may be used to set the drive currents that are provided to the respective first through third strings of LEDs 311, 312, 313 at levels that are set so the device 300 will emit combined radiation at or near a desired color point.

The device 300 further includes a control system 317 and a sensor 320. The sensor 320 may sense various characteristics such as, for example, the temperature of the device 300. Data regarding the sensed characteristics is provided from the sensor 320 to the control system 317. In response to this data, the control system 317 may automatically cause one or more of the first, second and third current control circuits 314, 315, 316 to adjust the drive currents that are provided to the respective first, second and third strings of LEDs 311, 312, 313. The control system 317 may be programmed to adjust the drive currents that are provided to the respective first, second and third strings of LEDs 311, 312, 313 in a manner that tends to maintain the color point of the light emitted by the device 300 despite changes in various characteristics such as the temperature of the device 300.

In some embodiments, the control system 317 may also be pre-programmed to make adjustments to the drive currents that is not responsive to data from sensor 320. For example, if the emissions of, for example, the LEDs in the third string of LEDs 313 degrades over time more quickly than the emissions of the first and second strings of LEDs 311, 312, then the control system 317 may be pre-programmed to, for example, cause the third current control circuit 316 to slowly increase the drive current that is provided to the third string of LEDs 313 over time (e.g., in discrete steps at certain time points) in order to better maintain the color point of the light emitted by the device 300 over time.

It will be appreciated that the sensor 320 and control system 317 of device 300 of FIG. 14 may be added to any of the previously described embodiments to provide similar functionality.

Figure 15:
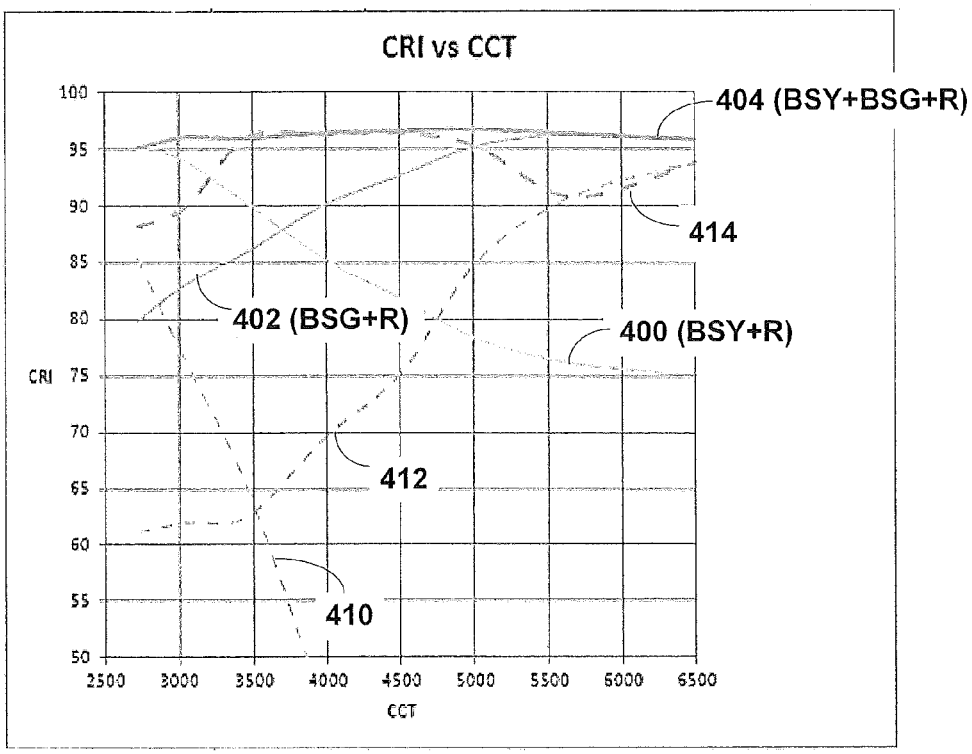
FIG. 15 is a graph illustrating the color rendering performance as a function of correlated color temperature of several different light emitting devices including certain light emitting devices according to embodiments of the present invention.

The light emitting devices according to embodiments of the present invention may exhibit excellent CRI with very high efficiency. Moreover, as noted above, this high performance may be achieved for a wide variety of correlated color temperatures (e.g., 2500K to 6500K). FIG. 15 is a graph that illustrates how this performance may be achieved.

In particular, FIG. 15 illustrates the relationship between CRI Ra and correlated color temperature for three different types of light emitting devices. Specifically, curve 400 in FIG. 15 plots the simulated CRI Ra performance of a "BSY+R" light emitting device that includes a string of BSY LEDs and a string of red LEDs. As shown in FIG. 15, at low correlated color temperatures (e.g., 2500K to 3500K) the BSY+R light emitting device exhibits good to excellent CRI Ra values, but does not exhibit such performance at higher correlated color temperatures, dropping to CRT Ra values of about 75 for correlated color temperatures of 6000K or more. FIG. 15 also shows at curve 402 the simulated CRI Ra performance of a "BSG+R" light emitting device that includes a string of BSG LEDs and a string of red LEDs. As shown in FIG. 15, at high correlated color temperatures (e.g., above about 4000K) the BSG+R light emitting device exhibits good to excellent CRI Ra values, but does not exhibit such performance at lower correlated color temperatures, dropping to a CRI Ra value of about 80 at a correlated color temperature of about 2700K.

As noted above, pursuant to certain embodiments of the present invention, light emitting devices ("BSG+BSY+R" devices) are provided that include a string of BSY LEDs, a string of BSG LEDs and a string of red LEDs. As shown at curve 404 in FIG. 15, these BSG+BSY+R devices may provide a CRI Ra value of 95 or more over the full correlated color temperature range of 2500K to 6500K.

FIG. 15 also illustrates the r9 performance for the light emitting devices BSY+R, BSG+R and BSG+BSY+R. As shown in curve 410 in FIG. 15, the r9 performance for the BSY+R device is about 85 at a color temperature of 2700K, and very quickly drops to below 50 with increasing color temperature. As shown in curve 412 in FIG. 15, the r9 performance for the BSG+R device is about 94 at a color temperature of 6500K, and drops off more slowly down to a value of about 62 at 2500K. As shown in curve 414 of FIG. 15, the r9 performance for the BSG+BSY+R device is above 88 for all correlated color temperatures between 2500K and 6500K, and is above 95 for correlated color temperatures between about 3300 k and about 4700K. Thus, FIG. 15 demonstrates that the light emitting devices according to certain embodiments of the present invention may provide excellent color-rendering properties over a wide range of correlated color temperatures. Moreover, all of the BSG+BSY+R devices that were plotted in the graph of FIG. 15 exhibited an output of at least 130 lumens/watt, showing that these devices also exhibited excellent luminous efficiency.

Figure 16:
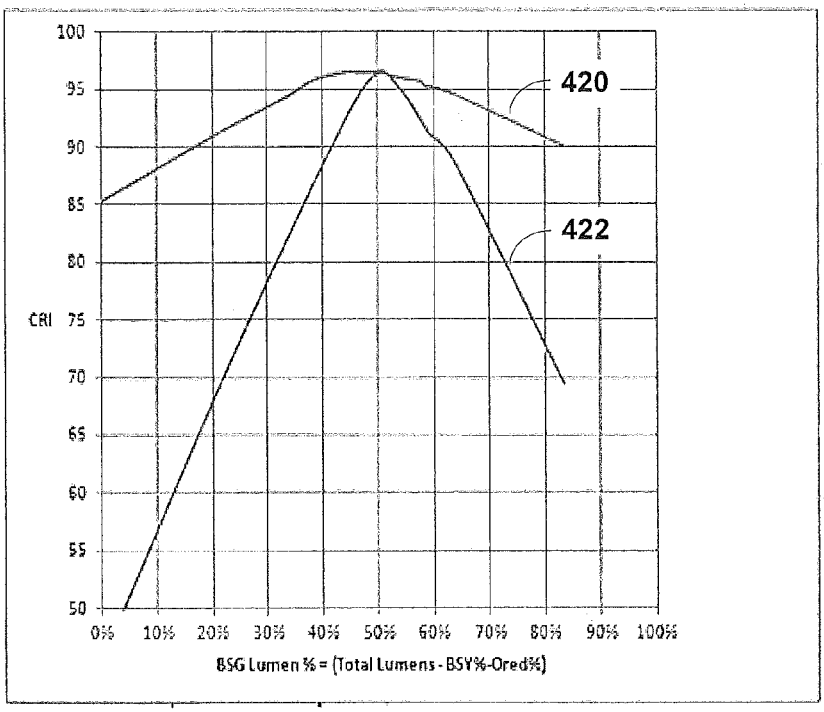
FIG. 16 is a graph illustrating the color rendering and luminous efficiency performance of light emitting devices according to certain embodiments of the present invention as a function of the percent of the luminous output provided by the green light-emitting LEDs included in the light emitting device.

Pursuant to further embodiments of the present invention, it has been discovered that for BSG+BSY+R light emitting devices, the color rendering performance (i.e., CRI Ra and r9 performance) may, at least in some cases, be optimized with little loss in efficiency. By way of example, FIG. 16 is a graph that plots the CRI Ra (curve 420) and r9 (curve 422) performance of a plurality of BSG+BSY+R light emitting devices (each of which had a correlated color temperature of about 3985) as a function of the percentage of the lumen output that was contributed by the BSG LEDs. As shown by curve 420 in FIG. 16, the CRI Ra performance is about 85 in cases where the BSG LEDs provide essentially no contribution to the output, gradually increases to a value of 97 in cases where the BSG LEDs provide about 50% of the luminous output, and then decreases to about 90 in cases where the BSG LEDs provide about 85% of the luminous output. As shown in FIG. 16, excellent CRI Ra performance (e.g., CRI Ra values of 95 or more) is provided in cases where the BSG LEDs provide between about 40% and about 60% of the luminous output. The r9 performance (curve 422) similarly peaks at a BSG LED luminous contribution of about 50%, and excellent r9 performance (e.g., r9 values of at least 90) are again provided in cases where the BSG LEDs provide between about 40% and about 60% of the luminous output. Excellent luminous efficiency is provided (135 lumens/watt or more) in cases where the BSG LEDs provide between about 40% and about 60% of the luminous output.

As discussed above, in some embodiments of the present invention, the color point of a semiconductor light emitting device may be adjusted to fall closer to a desired color point by adjusting the drive current provided to one or more independently controllable LED strings. It will be appreciated that drive current can be adjusted in a variety of ways. For example, in some embodiments, an absolute drive current level provided to one or more of the LED strings may be adjusted to move the color point. In other embodiments, the drive current provided to one or more LED strings may be turned on and off (e.g., using pulse width modulation) in order to reduce the average drive current that is provided to those LED strings. It will be appreciated that many other techniques may also be used.

Various embodiments of the present invention that are discussed above adjust the drive current supplied to one or more of multiple strings of light emitting devices that have separate color points in order to adjust a color point of the overall light output of the device. It will be appreciated that there are numerous ways to provide strings of light emitting devices that have different color points. For instance, in some of the embodiments discussed above, identical LEDs may be used in each of the multiple strings, while each of the strings use different recipient luminophoric mediums in order to provide multiple strings having different color points. In other embodiments, some strings may use the same underlying LEDs and different recipient luminophoric mediums, while other strings use different LEDs (e.g., a saturated red LED) in order to provide the multiple strings having different color points. In still further embodiments, some strings may use the recipient luminophoric mediums and different underlying LEDs (e.g. a first string uses 450 nm blue LEDs and a BSY recipient luminophoric medium and a second string uses 470 nm blue LEDs and the same BSY recipient luminophoric medium), while other strings use different LEDs and/or different recipient luminophoric mediums in order to provide the multiple strings having different color points.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

While embodiments of the present invention have primarily been discussed above with respect to semiconductor light emitting devices that include LEDs, it will be appreciated that according to further embodiments of the present invention, laser diodes and/or other semiconductor lighting devices may be provided that include the luminophoric mediums discussed above.

The present invention has been described above with reference to the accompanying drawings, in which certain embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that, when used in this specification, the terms "comprises" and/or "including" and derivatives thereof, specify the presence of stated features, operations, elements, and/or components, but do not preclude the presence or addition of one or more other features, operations, elements, components, and/or groups thereof.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, components, regions and/or layers, these elements, components, regions and/or layers should not be limited by these terms. These terms are only used to distinguish one element, component, region or layer from another element, component, region or layer. Thus, a first element, component, region or layer discussed below could be termed a second element, component, region or layer without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure.

Embodiments of the invention are described herein with reference to cross-section illustrations that are schematic illustrations of idealized embodiments (and intermediate structures) of the invention. The thickness of layers and regions in the drawings may be exaggerated for clarity. Additionally, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A method for fabricating a semiconductor light emitting device, the method comprising:

providing a first string of light emitting diodes ("LED") that comprises a first LED that has a first recipient luminophoric medium that comprises a first luminescent material that emits light comprising a peak wavelength within the green color range in response to radiation emitted by the first LED;

providing a second string of LEDs that comprises a second LED that has a second recipient luminophoric medium that comprises a second luminescent material that emits light comprising a peak wavelength within the yellow color range in response to radiation emitted by the second LED;

providing a third string of LEDs that comprises a third LED that emits light comprising a distinct spectral peak within the red color range or the orange color range;

selecting the LEDs included in the first string and in the second string so that when the first string and second string are operated at pre-selected drive current levels the combined light output of the first string and the second string is on a line on the 1931 CIE Chromaticity Diagram that is defined by the color point for the combined output of the third sting and a pre-selected color point for the light output by the semiconductor light emitting device.

2. The method of claim 1, wherein the pre-selected drive current levels are pre-selected based on efficiency characteristics for the LEDs in the respective first and second strings.

3. The method of claim 1, wherein the first string of LEDs further comprises a fourth LED that has a fourth recipient luminophoric medium that comprises a fourth luminescent material that emits light comprising a peak wavelength within the yellow color range in response to radiation emitted by the fourth LED.

4. The method of claim 3, wherein the second string of LEDs further comprises a fifth LED that has a fifth recipient luminophoric medium that comprises a fifth luminescent material that emits light comprising a peak wavelength within the green color range in response to radiation emitted by the fifth LED.

5. The method of claim 1, wherein the first recipient luminophoric medium further comprises a third luminescent material that emits yellow light in response to light emitted by the first LED.

6. The method of claim 5, wherein the second recipient luminophoric medium further comprises a fourth luminescent material that emits green light in response to light emitted by the first LED.

7. The method of claim 1, wherein the second recipient luminophoric medium further comprises a third luminescent material that emits green light in response to light emitted by the first LED.

8. The method of claim 1, wherein the semiconductor light emitting device further comprises a drive circuit that is configured to provide first, second and third drive currents to the respective first, second and third LED strings, wherein at least two of the first, second and third drive currents are independent of each other.

9. The method of claim 1, wherein a color point of the combined output of the first string of LEDs and a color point of the combined output of the second string of LEDs at the pre-selected drive current levels for the first and second strings of LEDs are approximately equidistant from the line on the 1931 CIE Chromaticity Diagram that is defined by the color point for the combined output of the third sting and the pre-selected color point for the light output by the semiconductor light emitting device.

10. The method of claim 1, further comprising setting a drive current for the third string of LEDs at the time of manufacture using at least one of an adjustable resistor, a resistor network, a digital-to-analog converter with flash memory or a fuse link diode.

11. A semiconductor light emitting device, comprising:

a first light emitting diode ("LED") string that comprises a first LED that has a first recipient luminophoric medium that comprises a first luminescent material that emits light comprising a peak wavelength within the green color range in response to radiation emitted by the first LED;

a second LED string that comprises a second LED that has a second recipient luminophoric medium that comprises a second luminescent material that emits light comprising a peak wavelength within the yellow color range in response to radiation emitted by the second LED;

a third LED string that comprises a third LED that emits light comprising a distinct spectral peak within the red color range or the orange color range; and a drive circuit that is responsive to input from an end user of the semiconductor light emitting device, the drive circuit configured to adjust the relative values of the drive currents provided to the LEDs in the first and second LED strings to adjust a color point of the light emitted by the semiconductor light emitting device.

12. The semiconductor light emitting device of claim 11, wherein the drive circuit is configured to allow the end user to adjust the color point of the light emitted by the semiconductor light emitting device to approximately move along a pre-selected portion of the black body locus on the 1931 CIE Chromaticity Diagram.

13. The semiconductor light emitting device of claim 12, wherein the drive circuit is factory set to provide a fixed drive current to the LEDs in the third LED string.

14. The semiconductor light emitting device of claim 11, further comprising a user input device that generates a control signal that is provided to the drive circuit.

15. The semiconductor light emitting device of claim 14, wherein the user input device comprises a first user input device and the control signal is a first control signal, the semiconductor light emitting device further comprising a second user input device that generates a second control signal that is provided to the drive circuit.

16. The semiconductor light emitting device of claim 14, wherein the user input device is configured to allow the end user to select a color point from a continuous range of color points.

17. The semiconductor light emitting device of claim 14, wherein the user input device comprises a first setting that controls the drive circuit to drive the first, second and third LED strings to emit light comprising a first color point comprising a color temperature between 4000K and 5000K and comprises a second setting that controls the drive circuit to drive the first, second and third LED strings to emit light comprising a second color point comprising a color temperature between 2500K and 3500K.

18. The light emitting device of claim 11, wherein the drive circuit is configured to drive the respective first, second and third LED strings so that they generate a combined light output comprising a color point that is within three MacAdam ellipses from a selected color point on the black-body locus.

19. A semiconductor light emitting device, comprising:

a first light emitting diode ("LED") string that comprises a first LED that has a first recipient luminophoric medium that comprises a first luminescent material that emits light comprising a peak wavelength within the green color range in response to radiation emitted by the first LED;

a second LED string that comprises a second LED that has a second recipient luminophoric medium that comprises a second luminescent material that emits light comprising a peak wavelength within the yellow color range in response to radiation emitted by the second LED;

a third LED string that comprises a third LED that emits light comprising a distinct spectral peak within the red color range or the orange color range; and a multi-position switch comprising a plurality of settings that correspond to a plurality of different pre-selected drive current values for driving the respective first, second and third LED strings to provide light comprising pre-selected color points.

20. The semiconductor light emitting device of claim 19, wherein the pre-selected color points comprise multiple color points that are along a pre-selected portion of the black body locus on the 1931 CIE Chromaticity Diagram.

21. The semiconductor light emitting device of claim 19, wherein the semiconductor light emitting device emits a warm white light comprising a correlated color temperature between about 2500K and about 4100K, a CRI Ra value of at least 90 and an r9 value of at least 90.

22. The semiconductor light emitting device of claim 19, wherein the semiconductor light emitting device has a luminous efficiency of at least 130 lumens/watt.

* * * * *